US008235921B2

(12) United States Patent
Rousso et al.

(10) Patent No.: US 8,235,921 B2
(45) Date of Patent: Aug. 7, 2012

(54) COMPUTERIZED PORTABLE DEVICE FOR THE ENHANCEMENT OF CIRCULATION

(75) Inventors: Benny Rousso, Rishon LeZion (IL); Eliahu Eliachar, Haifa (IL); Uri David, Ness Ziona (IL); Yuval Avni, Givatayim (IL)

(73) Assignee: Flow Medic Limited, Hamilton (BM)

( * ) Notice: Subject to any disclaimer, the term of this patent is extended or adjusted under 35 U.S.C. 154(b) by 1077 days.

(21) Appl. No.: 11/913,274

(22) PCT Filed: May 1, 2005

(86) PCT No.: PCT/IL2005/000446

§ 371 (c)(1),
(2), (4) Date: Jun. 26, 2008

(87) PCT Pub. No.: WO2006/117771

PCT Pub. Date: Nov. 9, 2006

(65) Prior Publication Data

US 2009/0118651 A1 May 7, 2009

(51) Int. Cl.
*A61H 7/00* (2006.01)

(52) U.S. Cl. ..... 601/134; 601/143; 601/144

(58) Field of Classification Search ..... 601/1, 11, 601/40, 41, 46, 84, 134, 143–144
See application file for complete search history.

(56) References Cited

U.S. PATENT DOCUMENTS

| | | | |
|---|---|---|---|
| 718,766 | A | 1/1903 | Ingram |
| 2,118,699 | A | 5/1938 | Chappell |
| 3,804,084 | A | 4/1974 | Lehman |
| 3,853,121 | A | 12/1974 | Mizrachy et al. |
| 4,004,579 | A | 1/1977 | Dedo |
| 4,243,039 | A | 1/1981 | Aginsky |
| 4,333,181 | A | 6/1982 | Corriero |
| 4,396,010 | A | 8/1983 | Arkans |
| 4,732,140 | A | 3/1988 | Stoffregen |
| 4,770,164 | A | 9/1988 | Lach et al. |
| 4,928,674 | A | 5/1990 | Halperin et al. |
| 4,982,732 | A | 1/1991 | Morris |
| 5,009,222 | A | 4/1991 | Her |
| 5,277,697 | A | 1/1994 | France et al. |
| 5,334,131 | A | 8/1994 | Omandam et al. |

(Continued)

FOREIGN PATENT DOCUMENTS

| | | |
|---|---|---|
| CH | 187824 | 11/1936 |

(Continued)

OTHER PUBLICATIONS

International Search Report and Written Opinion for PCT/IL2005/000446.

*Primary Examiner* — Michael A. Brown

(57) ABSTRACT

A portable limb-mounted device for enhancing blood and/or lymph flow in a limb and/or for preventing stasis related disorders, the device comprising an energy generating device, an actuator, one or more compressing elements for generating squeezing forces on the limb of a user, a sensor located adjacent to the body of the user and coupled to a transceiver device, and a transceiver device coupled to the sensor to receive signals generated by the sensor, to transfer the signals received from the sensor device to a computing device. The device further comprises a computerized control system including a microcontroller and a memory device to store activity related information for subsequent downloads to an external computer-based monitoring device.

18 Claims, 31 Drawing Sheets

U.S. PATENT DOCUMENTS

| | | | | |
|---|---|---|---|---|
| 5,399,153 | A | 3/1995 | Caprio et al. | |
| 5,407,418 | A | 4/1995 | Szpur | |
| 5,454,831 | A | 10/1995 | McEwen | |
| 5,472,413 | A | 12/1995 | Detty | |
| 5,513,658 | A | 5/1996 | Goseki | |
| 5,575,761 | A | 11/1996 | Hajianpour | |
| 5,738,637 | A | 4/1998 | Kelly et al. | |
| 5,769,801 | A | 6/1998 | Tumey et al. | |
| 5,865,776 | A | 2/1999 | Springs | |
| 5,873,848 | A | 2/1999 | Fulkerson | |
| 6,010,470 | A | 1/2000 | Albery et al. | |
| 6,135,116 | A | 10/2000 | Vogel et al. | |
| 6,174,295 | B1 | 1/2001 | Cantrell et al. | |
| 6,231,532 | B1 | 5/2001 | Watson et al. | |
| 6,290,662 | B1 | 9/2001 | Morris et al. | |
| 6,478,757 | B1 | 11/2002 | Barak | |
| 6,494,852 | B1 | 12/2002 | Barak et al. | |
| 6,551,280 | B1 | 4/2003 | Knighton et al. | |
| 6,616,620 | B2 | 9/2003 | Sherman et al. | |
| 6,780,163 | B1 | 8/2004 | Krusenklaus | |
| 7,004,919 | B2 | 2/2006 | Gaylord et al. | |
| 7,025,738 | B2 | 4/2006 | Hall | |
| 2002/0026131 | A1* | 2/2002 | Halperin | 601/41 |
| 2002/0042583 | A1 | 4/2002 | Barak et al. | |
| 2002/0169399 | A1 | 11/2002 | Rastegar et al. | |
| 2002/0177793 | A1 | 11/2002 | Sherman | |
| 2004/0073146 | A1 | 4/2004 | Weintraub et al. | |
| 2005/0027218 | A1 | 2/2005 | Filtvedt et al. | |
| 2005/0043657 | A1 | 2/2005 | Couvillon, Jr. | |
| 2005/0267387 | A1 | 12/2005 | Baldauf et al. | |
| 2006/0047232 | A1 | 3/2006 | Bourne et al. | |
| 2006/0074362 | A1 | 4/2006 | Rousso | |
| 2006/0122546 | A1 | 6/2006 | Rousso | |
| 2007/0055188 | A1 | 3/2007 | Avni | |
| 2007/0173886 | A1 | 7/2007 | Rousso et al. | |
| 2008/0015630 | A1 | 1/2008 | Rousso | |
| 2008/0039752 | A1 | 2/2008 | Rousso | |
| 2008/0097268 | A1 | 4/2008 | Rousso | |
| 2008/0146980 | A1 | 6/2008 | Rousso et al. | |
| 2008/0255494 | A1 | 10/2008 | Rousso et al. | |
| 2008/0269543 | A1 | 10/2008 | Rousso | |
| 2009/0118651 | A1 | 5/2009 | Rousso et al. | |

FOREIGN PATENT DOCUMENTS

| | | |
|---|---|---|
| EP | 19815487 | 10/1999 |
| WO | WO97/04820 | 2/1997 |
| WO | WO00/23034 | 4/2000 |
| WO | WO00/27334 | 5/2000 |
| WO | WO01/32124 | 5/2001 |
| WO | WO01/91364 | 11/2001 |
| WO | WO02/69879 | 3/2002 |
| WO | WO2005/051250 | 6/2005 |
| WO | WO2005/072674 | 8/2005 |
| WO | WO2005/074376 | 8/2005 |
| WO | WO2005/120424 | 12/2005 |
| WO | WO2005/120500 | 12/2005 |
| WO | WO2005/122269 | 12/2005 |
| WO | WO2006/033114 | 3/2006 |
| WO | WO2006/033115 | 3/2006 |
| WO | WO2006/035449 | 4/2006 |
| WO | WO2006/117771 | 11/2006 |

* cited by examiner

COMPUTERIZED PORTABLE DEVICE FOR THE ENHANCEMENT OF CIRCULATION

RELATED APPLICATIONS

The present application is related to Israel Patent Application serial number 160185 filed on 2 Feb., 2004 titled "A PORTABLE DEVICE FOR THE ENHANCEMENT OF CIRCULATION OF BLOOD AND LYMPH FLOW IN A LIMB" and to Israel Patent Application serial number 160214 filed on 4 Feb., 2004 titled "A PORTABLE DEVICE FOR THE ENHANCEMENT OF CIRCULATION OF BLOOD AND LYMPH FLOW IN A LIMB" and to co-pending U.S. patent application designated Ser. No. 10/469,685 titled "A PORTABLE DEVICE FOR THE ENHANCEMENT OF CIRCULATION AND FOR THE PREVENTION OF STASIS RELATED DVT", filed 3 Sep. 2003 with priority dated 5 Mar. 2001, and to PCT patent application filed concurrently and titled "A PORTABLE SELF CONTAINED DEVICE FOR ENHANCING CIRCULATION", the content of which is incorporated herein by reference.

BACKGROUND OF THE INVENTION

1. Field of the Invention

The present invention generally relates to enhancement of blood and/or lymph flow in general, and to a portable pneumatic self-contained device for applying intermittent pressure on a body part in particular. The present invention further relates to computer-based control systems and more specifically to a system and method for controlling a portable device and to a method and program product for monitoring the activity of the portable device.

2. Discussion of the Related Art

Peripheral vascular disorders include venous, arterial or combined arteriovenous disorders. Venous thrombosis may seriously affect superficial or deep veins. Over time, serious conditions may develop to include edema, pain, stasis pigmentation, dermatitis, ulceration and the like. Serious cases of venous thrombosis may lead to phlegmasia cerulea dolens in which the extremities of the patient turns blue and may lead to gangrene and death. Various other ailments and conditions are likely to result from complications of venous thrombosis.

It is thought that most venous thrombosis occurrences begin in the valve cusps of deep calf veins. Tissue thromboplastin is released, forming thrombin and fibrin that trap RBCs and propagate proximally as a red or fibrin thrombus, which is the predominant morphologic venous lesion. Anticoagulant drugs such as heparin, the coumarin compounds, can prevent thrombosis from forming or extending. Antiplatelet drugs, despite intensive study, have not proved effective for prevention of venous thrombosis. Symptoms can appear within hours or sometimes longer. Other related venous conditions are varicose veins associated with valvular dysfunction causing aching, fatigue, and in some case subcutaneous induration and ulceration, superficial thrombophlebitis and even pulmonary embolism.

Arterial vascular disorders such as peripheral arterial occlusion may result in acute ischemia manifested in cold, painful and discolored extremities. In acute cases, the locations distal to the obstruction will be absent of pulse. Chronic occlusion will be manifested in the patient being able to walk to a lesser distance as the diseases progresses, causing unrelenting pain to the extremities, compromising tissue viability and leading to gangrene, Increasing the flow of blood or lymph in the limb during periods of immobility is already a proven method to prevent the formation of DVT in the limb and to ease the suffering of peripheral vascular disorders. It secondarily prevents the formation of pulmonary embolism that commonly originates from such disorders. Increasing the venous return and arterial flow can also prevent formation of edema, pain and discomfort in the limb during periods of immobilization and assist in the prevention of arterial stenosis and occlusion.

Reduced circulation through a limb can also be observed in conditions affecting the arterial system such as in diabetes mellitus. It is believed that various vascular alterations such as accelerated atherosclerosis, where the arterial walls become thickened and loss their elasticity, diabetic microangiopathy, affecting capillaries, as well as neuropathy (loss and dysfunction of nerves) are responsible for the impaired circulation in the diabetic limb. The reduced blood supply to the limb entails stasis and ischemia in the distal limb. This ischemia leads to tissue death (necrosis) and secondary infections and inflammations. In addition, lack of cutaneus sensation caused by the loss of sensory nerves due to the diabetic neuropathy prevents the patient from being alert to the above-mentioned condition developing.

Enhancing circulation in general and prevention of stasis related disorders in particular, is achieved via non-portable large and cumbersome devices. Most of these devices can be used only by trained medical staff. Other methods of treatment suggest the use of warm compresses and medication.

Accordingly it is the object of the present invention to provide intermittent compression device for the enhancement of blood and lymph flow in a limb which is portable, self-contained and easily carried, small and lightweight, is easy to manufacture and is low cost. Such device will have enhanced energetic abilities enabling the efficient suction of blood and lymph though the arterial vessels. A further object of the invention is to provide such a device with sensors for data gathering of the physiological condition of the user or patient. Another objective of the present invention is to provide the device with an antenna and a microprocessor to enable the processing of the data gathered and the transmission of data gathered to a remote location. Another objective of the present invention is to provide the device with a computer-based control system. Yet another objective of the present invention is to provide computer-based activity monitoring for the device.

It is a further object of the present invention to provide such a device which is simple to operate by a lay person without any special training in the field of medicine, is easily strapped over or attached to a limb and can be easily adjusted to fit persons of any size.

Other advantages of the invention will be apparent from the description that follows.

SUMMARY OF THE PRESENT INVENTION

In accordance with the above objects, the present invention provides a portable device and method for enhancing blood and/or lymph flow in a limb and/or for reducing the risk of Deep Vein Thrombosis formation by applying periodic squeezing forces on a limb, in particular a lower limb.

The device of the present invention is a small, portable, simple, leg or limb-mounted mechanical device that produces intermittent mechanical compression of the deep venous system in a limb, more specifically the lower limb, by converting energy, more specifically electrical or magnetic energy into mechanical compressions, more specifically via strap compression or plate compression by the use of rods and wheel mechanical apparatus.

The present device comprises a casing box, preferably a flask-like curved box for fitting the curvature of the limb, and a strap connected by its two ends to opposite sides of said casing box such as to form a closed loop around the limb. The casing box contains a power source means, a motor powered by said power source means and a mechanical means coupled to said motor for actuating periodical change in the circumference of said closed loop between a contracted and a relaxed positions. Said periodical change in the circumference of said closed loop is obtained either by intermittently pulling and releasing at least one end of the strap toward the casing or by intermittently extending and retracting a compressive plate positioned between the casing and the limb. The periodical transition between the contracted and relaxed positions may be controlled such as to allow different time periods in each position. Preferably, a cycle comprises a fast contraction, followed by much longer period of relaxation. The device further comprises adjustments means for adjusting the circumference of the loop to the circumference of said limb.

Preferably the device further comprises regulation means for regulating the frequency of said periodical change and for regulating the length interval between said contracted and relaxed positions of said loop.

The device further comprises a control system constituted by electrical components under the control of a microprocessor having a memory for recording and storing device-specific activity information designed to be downloaded to an external monitoring device, such as a computing device for subsequent processing and viewing.

One aspect of the present invention regards a portable limb-mounted device for enhancing blood and/or lymph flow in a limb and/pr for preventing stasis related disorders. The device comprises several sensors located adjacent to the body of the user or in proximity to the body of the user or distally to the body of the user and coupled to a transceiver device, to measure physical body parameters of the user, and to generate electronic signals representing body parameter values, and a transceiver device coupled to the sensors to receive signals generated by the sensors, to transfer the signals received from the sensors to a computing device.

The second aspect of the present invention regards a system for controlling the operation of a computerized portable limb-mounted device for enhancing blood and/or lymph flow in a limb and/or for preventing stasis related disorders. The system comprises a microcontroller having a memory to store a control program for controlling the operation of the computerized portable limb-mounted device, for recording information indicative of the operations of the portable limb-mounted device and to enable downloading of the information to an external monitoring device.

The third aspect of the present invention regards a method for controlling the operation of a computerized portable limb-mounted device for enhancing blood and/or lymph flow in a limb and/or for preventing stasis related disorders. The method comprises determining the mode of operation of the computerized portable limb-mounted device, executing operational-mode specific operations in accordance with the determined operational mode, and modifying the operational mode of the computerized portable limb-mounted device.

The fourth aspect of the present invention regards a method for monitoring the activity of a computerized portable limb-mounted device for enhancing blood and/or lymph flow in a limb and/or for preventing stasis related disorders. The method comprises accessing and downloading activity specific information recorded on the computerized portable limb-mounted device from an external monitoring device, receiving and storing health establishment information, physician information, and patient information on the external monitoring device; and displaying historical treatment information of a client by the computerized portable limb-mounted device on the external monitoring device.

The fifth aspect of the present invention regards a program product for monitoring the activity of a computerized portable limb-mounted device for enhancing blood and/or lymph flow in a limb and/or for preventing stasis related disorders. The program product comprises a patent routine visit screen to view historical treatment information of the patient by the computerized portable limb-mounted device; and a device assignment to a patient screen to assign a portable limb-mounted device to a patient.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

A device for the intermittent compression of the extremities muscles for the enhancement of blood and/or lymph flow in a limb and/or the prevention of Deep Vein Thrombosis is disclosed. The device of the present invention comprises further sensors, antennas and transceivers and is able to communicate with a remote location. The device of the present invention further comprises an energy generating mechanism, an actuator and at least one pressing element.

Figure 1:
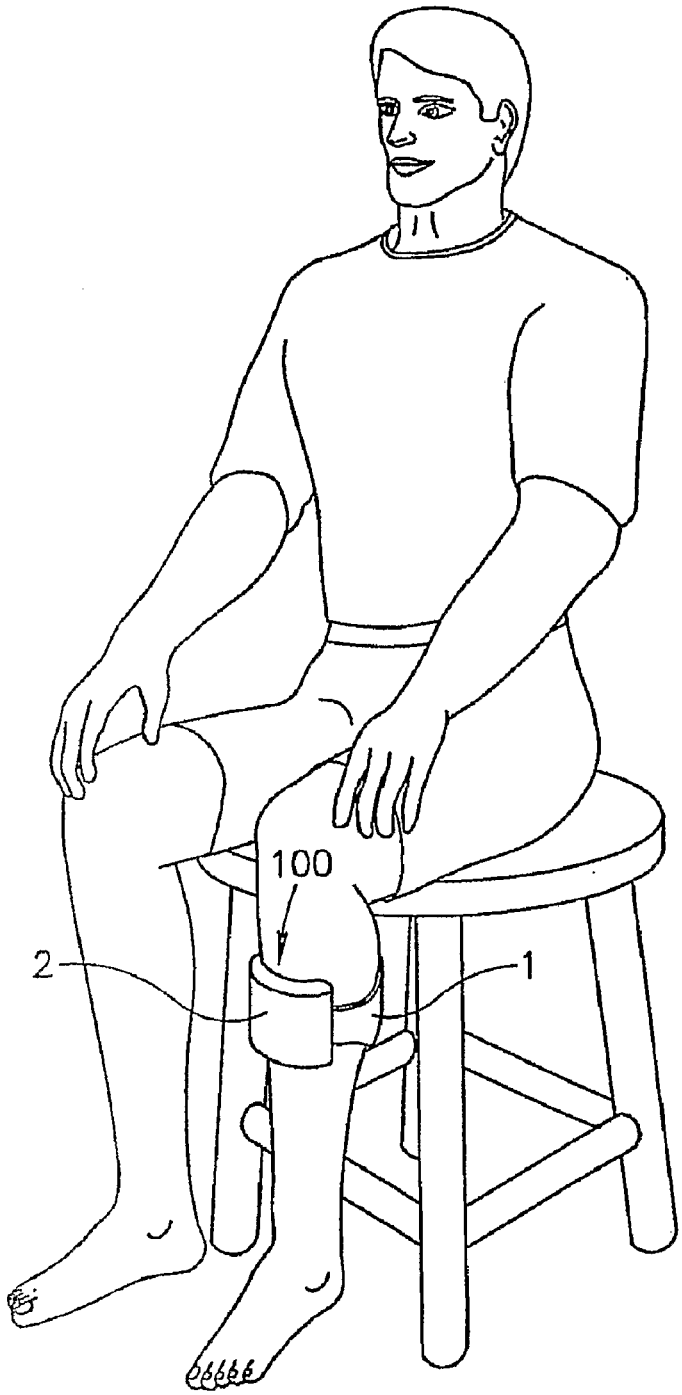
FIG. 1 is a pictorial illustration of the device of the present invention strapped to the calf of a sitting person.

The portable limb-mounted device of the present invention, generally designated 100, is shown in FIG. 1, worn on the calf of a sitting person, Device 100 can be worn directly on the bare limb, or on a garment, such as trousers, worn by the person using the device.

Device 100 comprises two main components, an assembly box 2 which contains all the machinery parts responsible for the device operation, and a strap 1 connected to said assembly box such as to form a closed loop (designated 50, see FIG. 2) for encircling a person limb. The power supply for the device may be of the internal power supply type such as a rechargeable or non rechargeable low voltage DC batteries or an external power supply type such as an external power outlet connected via an AC/DC transformer such as a 3-12V 1 Amp transformer, fed through electrical wires to a receptacle socket in the device (not shown).

As shown in FIG. 1, strap 1 is preferably wide in the middle and narrow at the ends where it connects to assembly box 2. Strap 1 however may assume any other shape and form such as a constant width belt. The strap can be fabricated from any flexible material that is non-irritating to the skin, such as thin plastic, woven fabric and the like. Strap 1 can be fabricated from one material or alternatively can combine more than one material. For example, strap 1 can be made of both non stretchable material and stretchable material wherein such an arrangement may be dispose of a stretchable material for example rubber fabric in the center of the strap 1 and a non stretchable material such as plastic flanking the stretchable material and comprising the rest of the strap. Such an arrangement facilitates more uniform stretch forces on the strap as well as preventing the slippage of the strap from the limb.

According to the preferred embodiment shown in FIG. 1, hereinafter called the anterior box embodiment, strap 1 is placed against the muscles while assembly box 2 is placed against the calf bone. However, according to another embodiment of the present invention, hereinafter called the posterior box embodiment, assembly box 2 can be placed against the muscles.

Figure 2A:
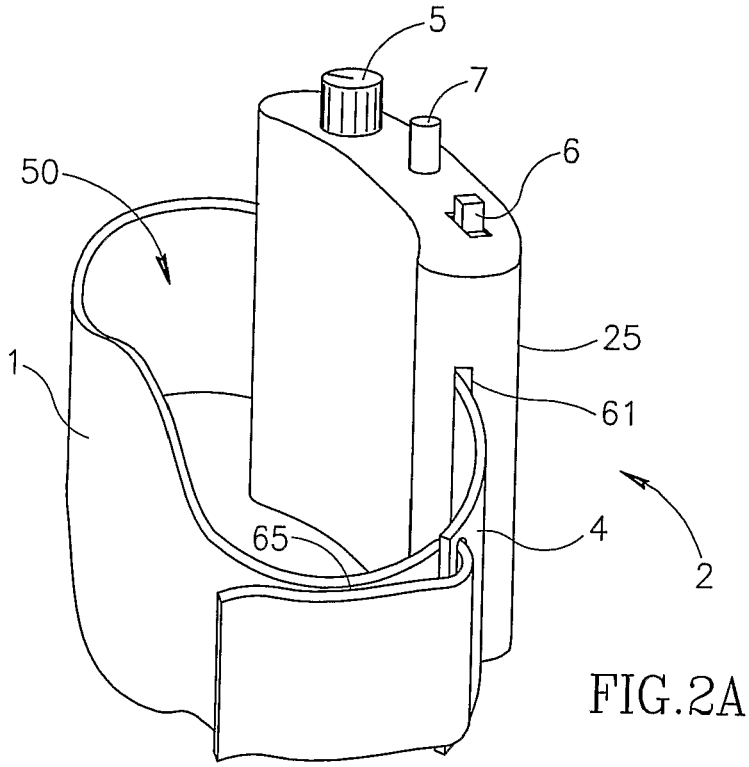
FIG. 2A is a side external view of a preferred anterior box embodiment of the present device, in which squeezing the limb muscles is performed by intermittent shortening the circumference of a loop created by an assembly body and strap.

FIG. 2 illustrate two possible embodiments of the device of the present invention. FIG. 2A represents a preferred embodiment of the present device, in which squeezing the limb muscles for promoting the increase of blood and/or lymph flow in the limb, is performed by pulling and releasing strap 1, thus, intermittently shortening the effective length of loop 50 encircling the limb. This embodiment is preferably used as an anterior box embodiment of the present invention. However, it will be easily appreciated that the device of FIG. 2A can be used as a posterior box embodiment as well.

Figure 2B:
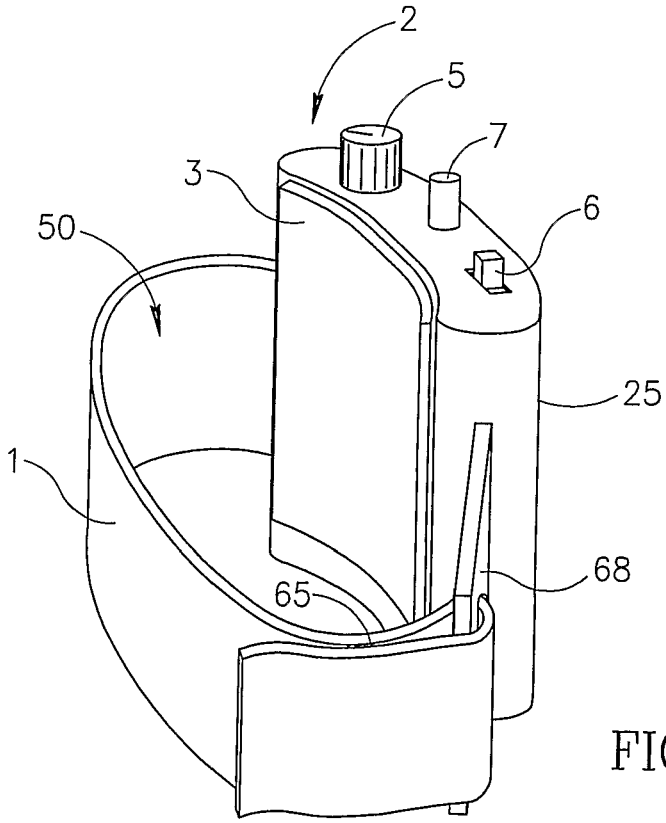
FIG. 2B is a side view illustration of a posterior box embodiment in which the assembly box is the active intermittent compressing part placed against the calf muscles.

FIG. 2B presents another embodiment of the present device in which assembly box 2 is the active intermittent compressing part by means of mobile plate 3 attached to the box. This embodiment, which can be used only as a posterior box embodiment, will be explained in conjunction with FIG. 6. Turning back to FIG. 2A, assembly box 2 comprises a thin, curved flask-shaped casing 25 which contains all the parts of internal machinery responsible for intermittent pulling and releasing strap 1. Casing 25 is preferably fabricated from, but not limited to, a plastic molding, a light metal, or any other material which is light, non irritating to the skin, and cheep to produce. Strap 1 is connected at both its ends to assembly box 2 by means of two buckles 4 and 42 at the sides of casing 25 (buckle 42 not shown). At least one of said buckles (here buckle 4) is a mobile buckle, which can move in and out of casing 25 through slit (opening) 61, thus pulling and relaxing strap 1 between a retracted and a relaxed positions. The retraction protraction motion shortens and lengthens the effective length of strap 1, thus causing intermittent compression of the underlying muscle and increasing the/or and lymph flow in the underlying vessels. Possible inner machinery responsible for activating the intermittent pulling of strap 1 is described in the following in conjunction with FIGS. 3 to 6. Strap 1 can be adjusted to fit the size of the limb, on which device 100 is to be operated, by having at least one of its ends free to move through its corresponding buckle, such that the strap can be pulled by said end for tightening the strap around said limb. Said end is then anchored in the appropriate position. In the example shown here, the strap is folded back on itself and the overlapping areas are fastened to each other by fastening means 65, such as Velcro™ strips, snap fasteners or any other fastening or securing means. Alternatively, said strap end can be secured to casing 25 by fastening means such as Velcro strips, opposite teeth-like protrusions both on casing 25 and on strap 1, and the like. The second end of strap 1 can be connected to its corresponding buckle either in a permanent manner by attaching means such as knots or bolts, or can be adjustable in a similar manner to what had been described above, allowing both ends to be pulled and anchored simultaneously for better fitting. Yet, in accordance with another embodiment of the invention, the strap can be wound around a retracting mechanism positioned at one side of casing 25. The free end of the strap can be provided with a buckle for allowing connection into the opposite side of casing 25 either by one of the aforementioned means described or by means of a quick connector. Outer casing box 25 also includes an on/off switch 6, a force regulator 5 for regulating the force exerted on the calf muscle by strap 1 and a rate regulator 7 for regulating the frequency of intermittent compressions. Alternatively, force regulator 5 and on/off switch 6 can be combined into one button. Force regulation can be obtained for example by way of controlling the length of the strap interval between retracted and protracted positions. The length interval between contracted and relaxed positions is preferably, but not limited to, 1-50 millimeters. Frequency regulation can be obtained by way of regulating, but not limited to, the speed of the inner machinery. A person skilled in the art will readily appreciate that the present invention can be used for the enhancement of both arterial and venous/or and lymph flow in a limb (upper and lower). The examples provided in the following discussion serve as an example and should not be construed as a limitation to the application of the preset invention.

Figure 3A:
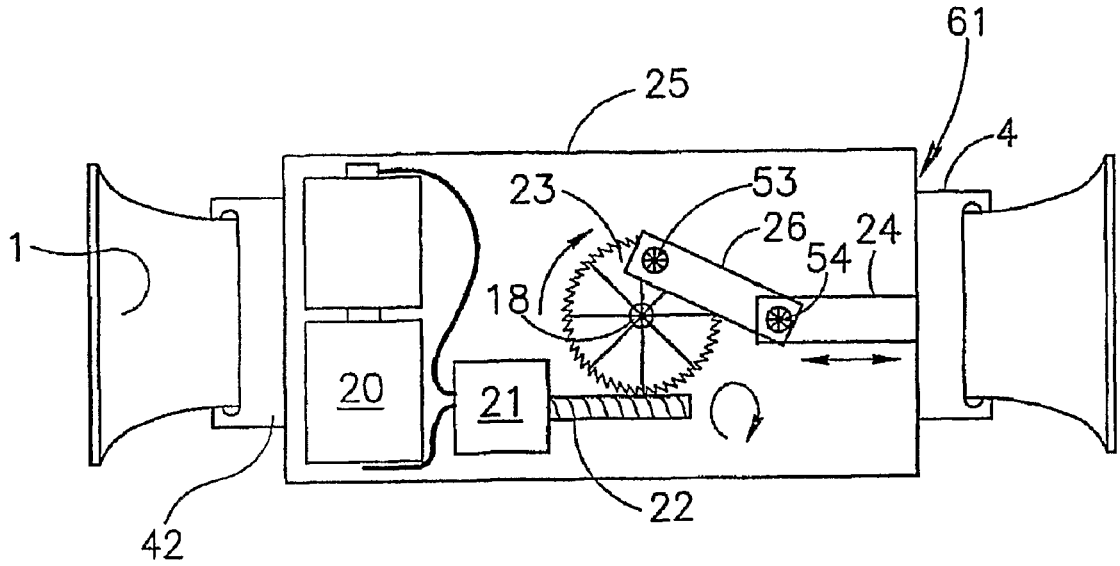
FIG. 3A is a cross section of a device in accordance with the embodiment of FIG. 2A, showing a first internal mechanism of the assembly box.
Figure 3B:
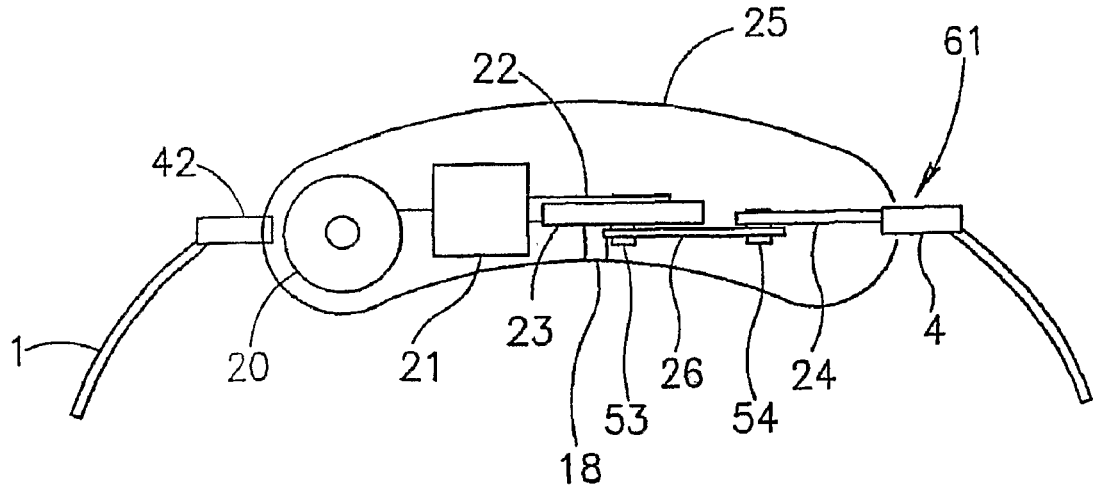
FIG. 3B is a top view of the device of FIG. 3A.
Figure 3C:
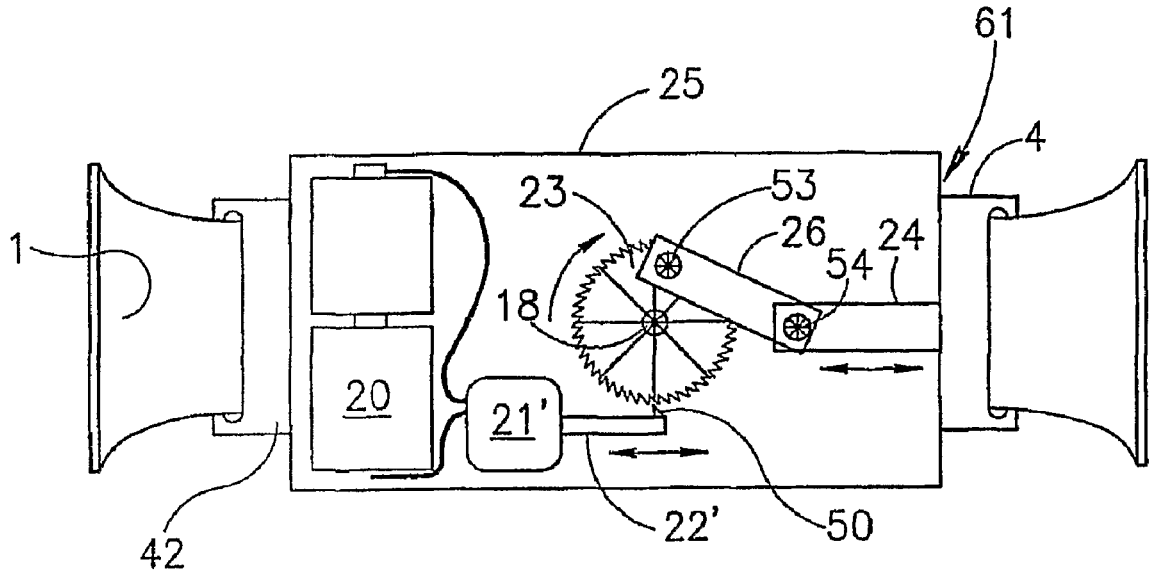
FIG. 3C depicts a modified mechanism of the embodiment of FIGS. 3A and 3B.

Referring now to FIGS. 3A and 3B, there is shown a side view and a top view respectively of first inner machinery for the device of FIG. 2A. The numerical are corresponding in both drawings. According to this embodiment, one end of strap 1 is connected to assembly box 2 via a fixed fitting 42 by means such as bolts, knots glue, etc. The second end is connected via a movable buckle 4, which traverses slit 61 located at the side of casing 25. Buckle 4 can retract and protract through opening 61, as described above. Movable buckle 4 is connected to the inner machinery by means of attachment to a rigid push/pull rod 24. The inner machinery responsible for the motion of movable buckle 4 is herein described. Energy source 20 such as low voltage DC batteries, supplies electrical energy to an electrical motor 21 such as, but not limited to, a 3-12 V DC motor, via electrical contacts such as wires. Electric motor 21 converts electric energy into kinetic energy, spinning a spirally grooved (worm) central shaft 22. Shaft 22 is coupled to a (speed reduction) wheel 23, having complementary anti-spiral circumferential grooves or teeth, causing wheel 23 to revolve around its center which is fixed by axis 18 perpendicular to its surface. An elongated connector plate 26 is pivotally jointed at one end to off-center point 53 on wheel 23 and at its second end to rod 24 at point 54, such that the rotation of wheel 23 actuates plate 26 to intermittently push and pull rod 24, in a crankshaft manner. Consequently, mobile buckle 4 is intermittently pulled inward and outward casing 25 through slit 61, thus intermittently shortening the circumference of loop 50. Modified machinery, represented in FIG. 3C, includes the following changes with reference to FIGS. 3A and 3B. The electric motor 21 and spinning worm shaft 22 are replaced with an electromagnetic motor 21' (such as a push-pull solenoid 191C distributed by Shindengen electric Ltd.) having a reciprocating central rod 22' with an upwardly inclined spike-tooth projection 50 at its end. Rod 22', via projection 50 is coupled to wheel 23, having complementary teeth. As reciprocating rod 22' slightly protrudes from, and retracts into the motor body, projection 50 latches sequential teeth of wheel 23 as it protrudes and pulls wheel 23 as it retracts, causing wheel 23 to revolve around its axis. The mechanism of FIG. 3C generates a large force output while minimizing the power input. Such machinery is very cost effective. The above description clearly shows how the internal mechanical machinery of the proposed device acts to intermittently shorten loop 50, culminating in intermittent compression of the leg or hand muscle and leading to increase of venous return and helping in the prevention of the formation of deep vein thrombosis.

Figure 4A:
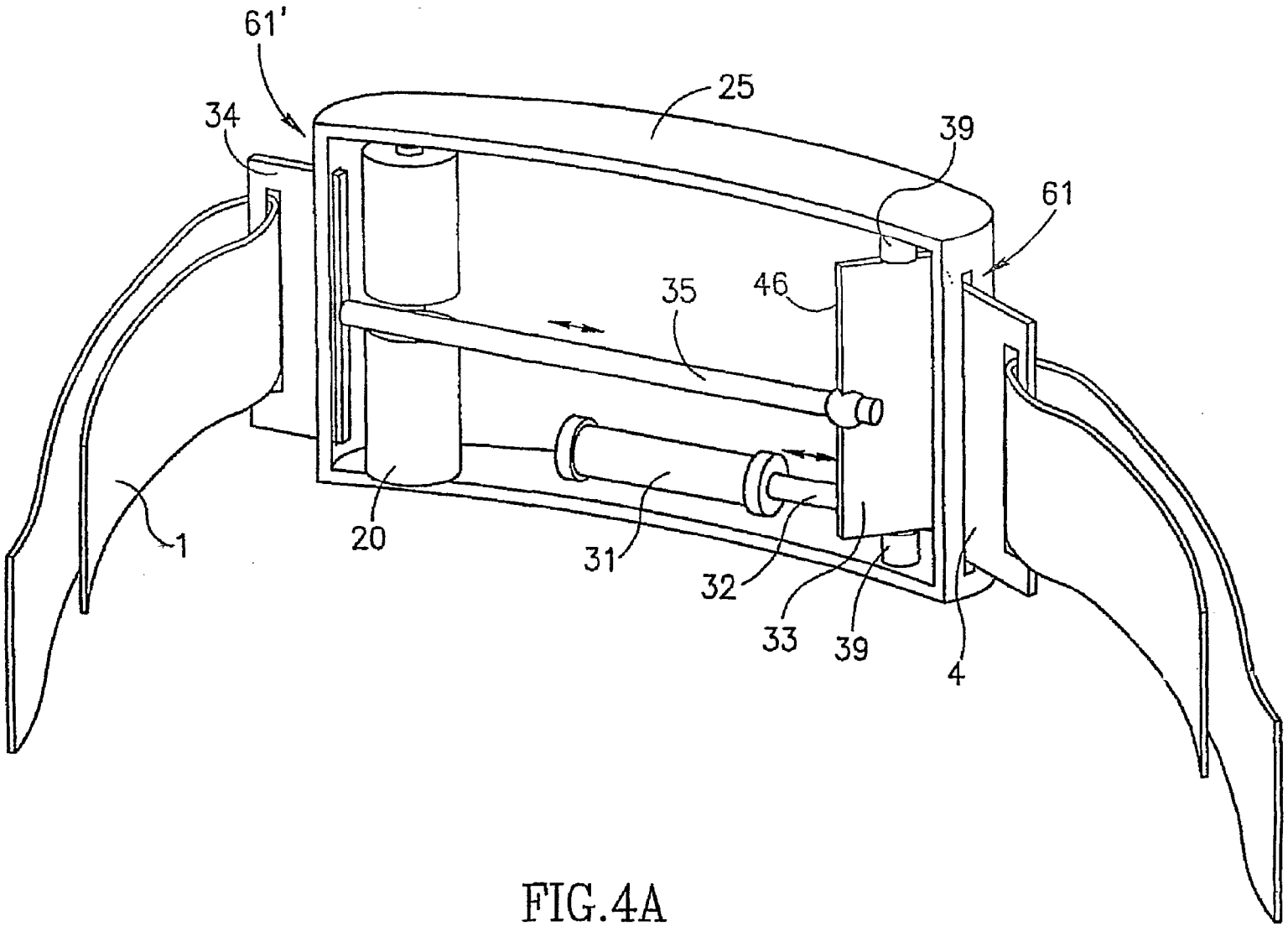
FIG. 4A is pictorial representation of an alternative mechanism for the embodiment of FIG. 2A using electromagnetic motor, a centrally hinged rotating rectangular plate and a longitudinal bar connecting both sides of the strap.
Figure 4B:
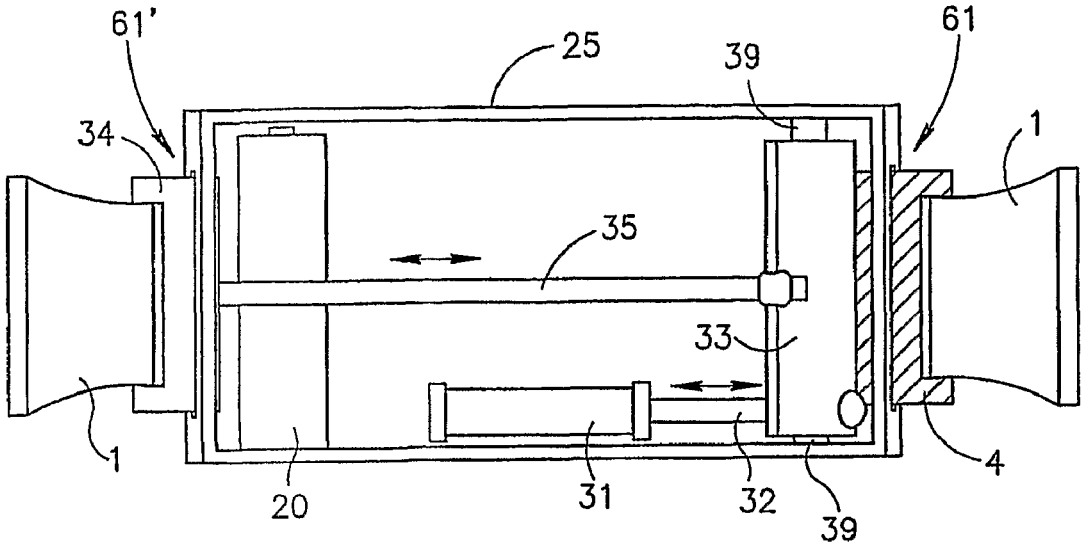
FIGS. 4B and 4C are side and top view respectively of the embodiment presented in FIG. 4A.
Figure 4C:
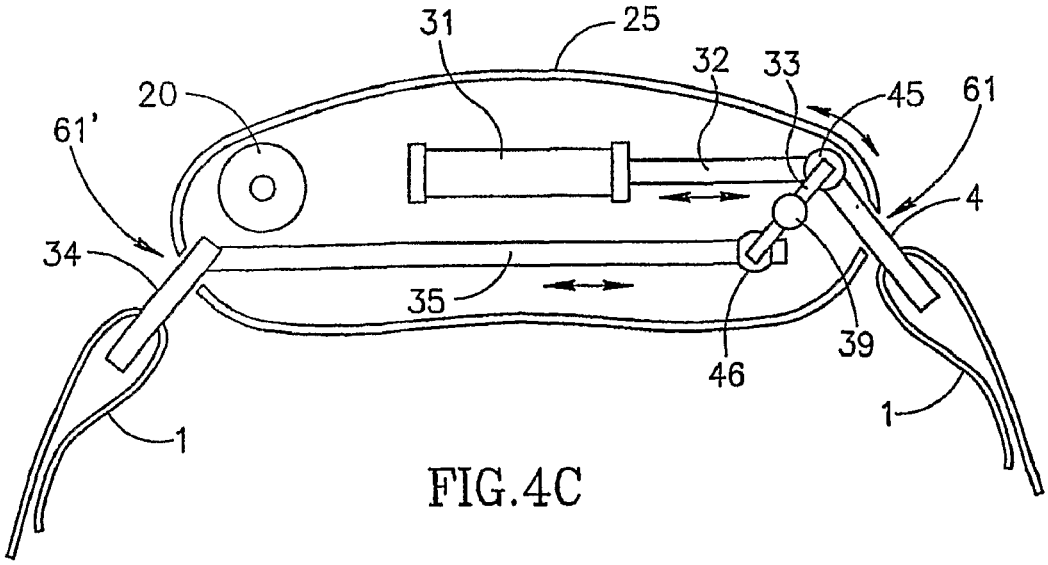

An alternative machinery embodiment for the device embodiment of FIG. 2A is shown in FIGS. 4A, 4B and 4C. FIG. 4A is a perspective drawing view showing the internal parts of assembly box 2 with the frontal part of casing 25 removed. FIGS. 4B and 4C side show the top view, respectively of the embodiment shown in FIG. 4A. According to this embodiment, both ends of strap 1 are connected to the inner machinery of assembly box 2 by means of two movable buckles 4 and 34, which can move inwardly, and outwardly casing 25 through slits 61 and 61', respectively. This alternative embodiment combines the following elements: A rectangular plate 33 positioned close to one side wall of casing 25, adjacent to slit 61. Plate 33 having two parallel rectangular surfaces, two narrow vertical edges, designated 45 and 46, and two narrow horizontal edges. Plate 33 is pivotally mounted at its narrow horizontal edges to the top and bottom walls of casing 25, by pivoting means 39, such as to allow rotational movement of the plate around the vertical axis connecting between pivoting means 39; A push-pull electromagnetic motor 31 (such as pull tubular solenoid 190 distributed by Shindengen electric Ltd.) connected via its reciprocating central rod 32 to one vertical edge (45) of the centrally hinged rectangular plate 33, at about mid point of said edge; A longitudinal rod 35 spans the length of casing 25. Said longitudinal rod 35 is connected at one end to the opposite vertical edge (46) of plate 33 and at its second end to movable buckle 34 positioned at the other side of casing 25. Centrally hinged rectangular plate 33 is thus connected on one side to the electromagnetic motor 31 via central rod 32, and on the other side to longitudinal rod 35 (as best seen in FIG. 4C). Movable buckle 4 is also connected to narrow edge 45 of plate 33 but extends outwardly, through slit 61, in the opposite direction to rods 32 and 35. As can be best seen in FIG. 4C, the reciprocating movement of rod 32 causes plate 33 to turn back and forth around its central axis, preferably the angular displacement is in the range of 20 to 60 degrees. Consequently, buckles 4 (coupled directly to plate 33) and 34 (by means of connecting rod 35) are synchronously pulled and pushed inward and outward of casing 25, resulting in intermittent shortening of the limb encircling loop. This embodiment is advantageous because the longitudinal rod 35 allows both buckles 34 and 4 to approximate each other at the same time, thus enhancing the efficiency of the device (by enhancing the reciprocating displacement of electromagnetic motor 31) and requiring less energy.

Figure 5A:
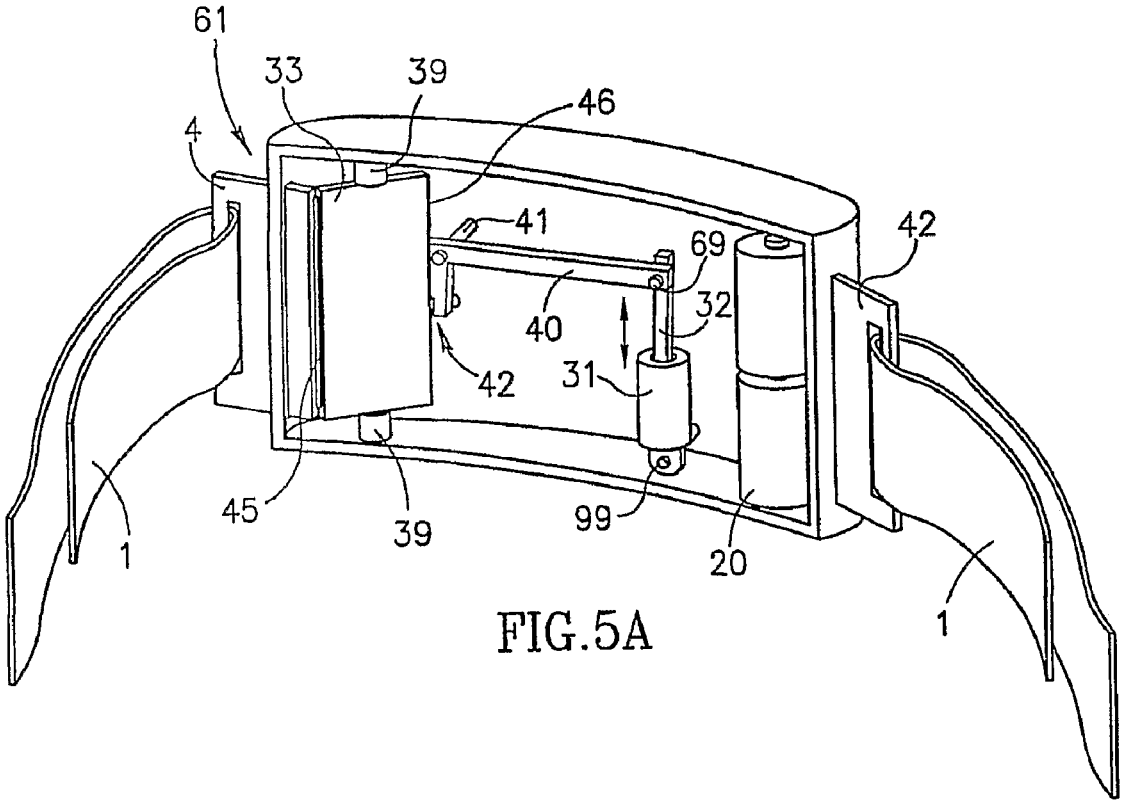
FIGS. 5A and 5B depict yet another mechanism for the embodiment of FIG. 2A using an enhanced power transmission by means of an "L" shaped lever bar.
Figure 5B:
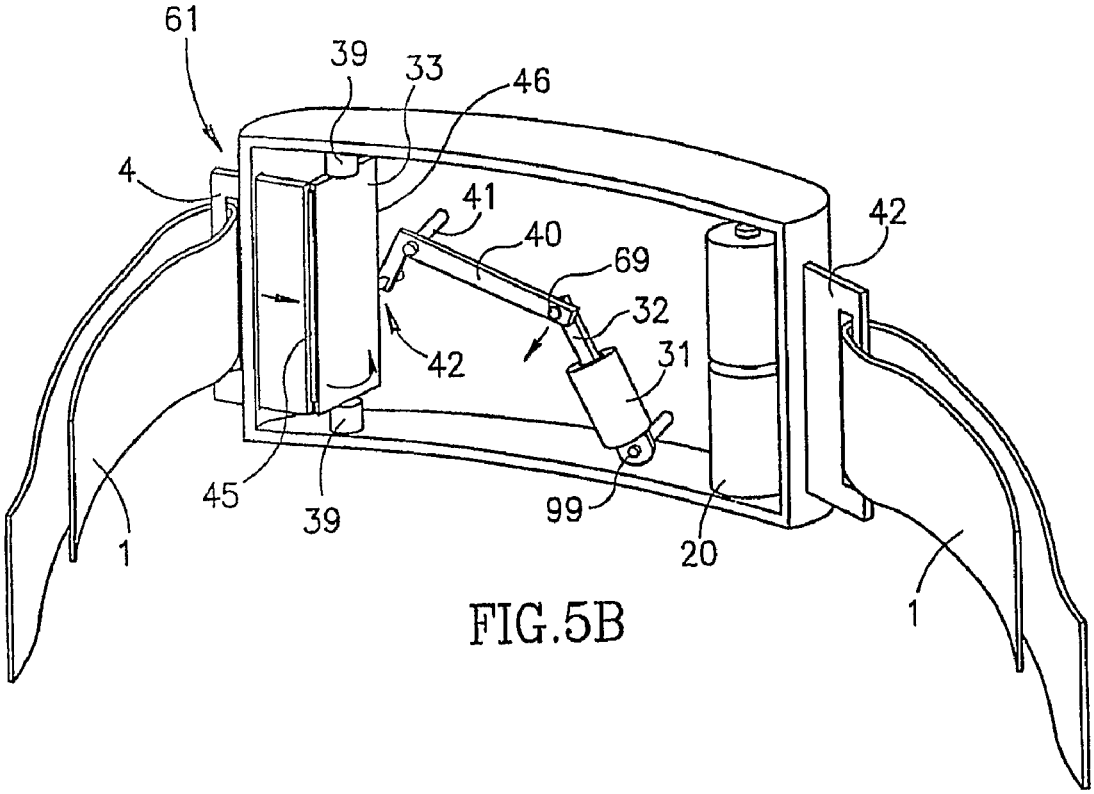

FIGS. 5A and 5B illustrate yet another alternative machinery for the device embodiment of FIG. 2A. The embodiment of FIG. 5 also uses a pull-push electromagnetic motor as the driving force but allows force enhancement by the addition of an "L" shaped lever bar 40 to the said centrally displaced rod 32 of the embodiment shown in FIG. 4. According to this embodiment, one edge of strap 1 is connected to fixed buckle 42 while the second end is connected to movable buckle 4 which transverse casing 25 through side slit 61. The movable buckle 4 is connected to centrally hinged rectangular plate 33 in a similar manner to what have been described in conjunction with FIG. 4. In accordance with the present embodiment, electromagnetic motor 32 is pivotally mounted at its rear end to the base by pivoting means 99. The "L" shaped lever bar 40 pivotally mounted at its longer arm end to reciprocating rod 32 by pivoting means 39, and at its shorter arm end is attached to narrow edge 46 of plate 33, by attaching means 42, in a manner which allows it to slide up and down said edge. Such attaching means can be obtained, for example, by railing means such as a groove engraved along the edge of the short arm of lever 40 and a matching protruding railing extending from narrow edge 46 of plate 33. The right-angled corner of "L" shaped bar 40 is pivotally anchored to casing 25 by means of axis 41 perpendicular to the bar surface. FIG. 5A represents the "relaxed" mode (i.e., buckle 4 in protracted position), while FIG. 5B is in a "contracted" mode (buckle 4 in retracted position). To understand the action of this embodiment a static description of the "relaxed" mode followed by the "contracted" mode description is herein given. The "relaxed" mode in FIG. 5A, illustrates the electromagnetic motor 32 at a perpendicular position to the base of casing 25, and "L" shaped lever 41 in a perpendicularly positioned to reciprocating rod 32. The "contracted" mode is shown in FIG. 5B. When reciprocating rod 32 retracts into electromagnetic motor 31, it causes the "L" shaped to rotate around axis 41, such that connection 69 moves toward electromagnetic motor 31 as well as toward the rectangular plate 33. This rotation is allowed due to pivot attachment 99 of electromagnetic motor 31 and pivot attachment 41 of "L" shaped lever bar 40. The other end of the "L" shaped lever bar 41 slides in the upward direction on edge 46 of rectangular plate 33 and at the same time it pushes plate 33 causing it to rotate counterclockwise such that edge 45 and consequently buckle 4 are drawn deeper into casing 25. When reciprocating rod 32 reciprocates its motion, "L" shaped bar 41 returns to its "relaxed" perpendicular position (FIG. 5A) and consequently edge 45 along with buckle 4 are pushed outwardly. Thus, this chain of events leads to an effective intermittent shortening of the limb encircling loop (50) and to an intermittent compression of the underlying muscle enhancing the blood flow.

Figure 6:
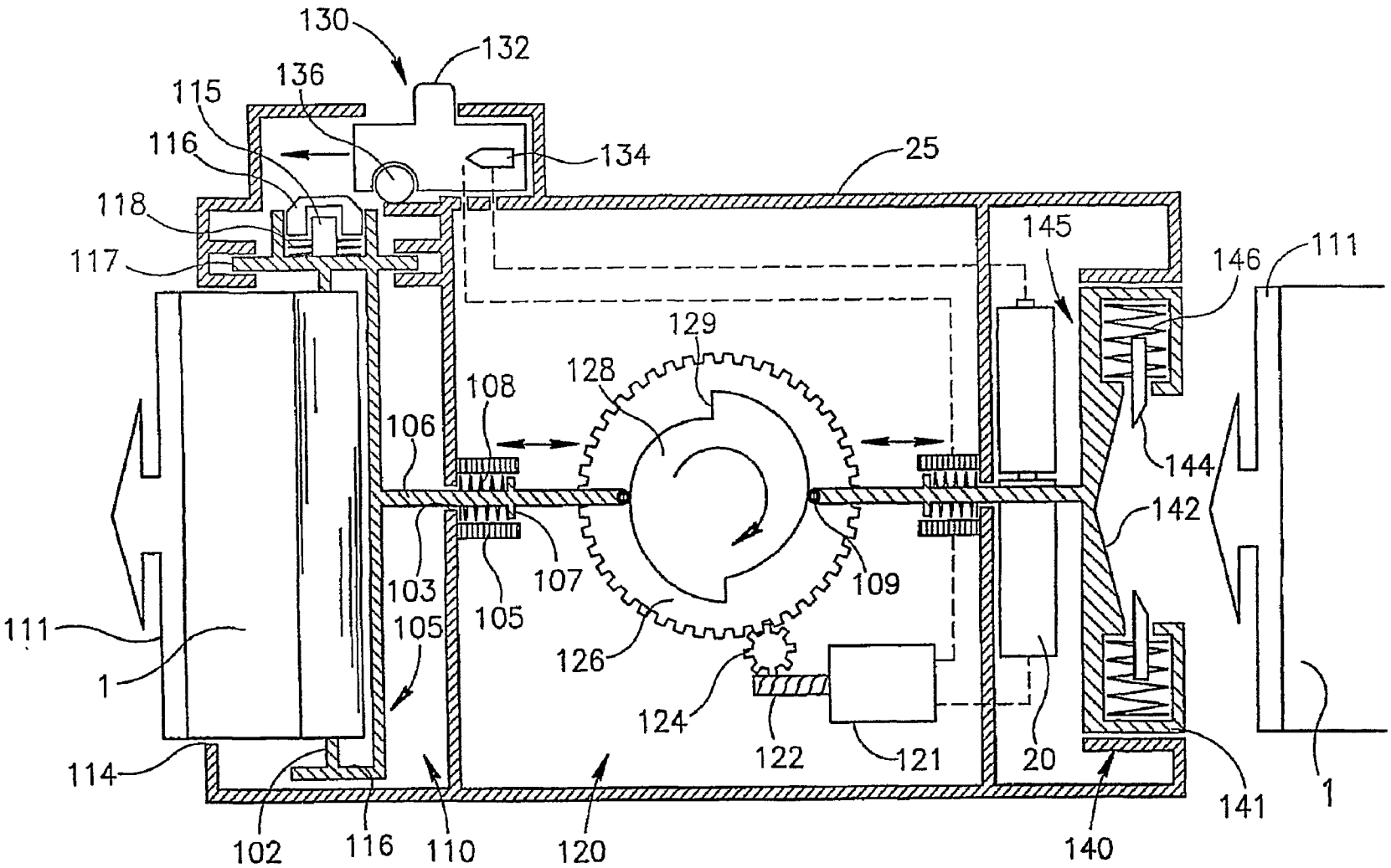
FIG. 6 is a side view of yet another embodiment of a device in accordance with the present invention.

FIG. 6 illustrates yet another preferred embodiment of the present invention, including means for allowing asymmetrical contraction-relaxation cycle and in particular for allowing fast contractions, followed by much longer periods of relaxation. Such a cyclic pattern is found to have the most beneficial effect for enhancing blood and lymph flow. In accordance with this embodiment, the machinery components responsible for intermittent pulling and releasing strap 1 comprises a motor 121 having a worm shaft 122, a speed reducing gear comprising wheels 124 and 126, coupled to shaft 122, and a disk 128 of irregular perimeter, concentrically mounted on wheel 126. Double-tooth disk 128 is shaped as two identical halves of varying curvature radius, each having a gradual slope at one end and a cusp 129 where the radius changes abruptly from maximum to minimum at its second end, wherein between two ends the radius of curvature is almost constant. The machinery components, including motor and wheels, are accommodated in a central compartment 120 of casing 25. Two side compartments, 110 and 140, accommodate laterally movable strap connectors 105 and 145, respectively. Compartments 110 and 140 are provided with side slits 114 and 141, through which strap 1 can slide in and out. In accordance with the embodiment shown here, strap 1 is retractably mounted at one side of casing 25 (compartment 110) and having its free end provided with a quick male connector for connecting into complementary female connector in compartment 140. This strap fastening arrangement allows for quick and simple adjustment of the strap to the size of the limb and for exerting primary pressure on the muscles. Accordingly, connector 105 includes a vertical rod 102 rotatably mounted between two horizontal beams 116 and 117, allowing rod 102 to revolve around its axis for rolling/unrolling strap 1. Strap 1 is affixed to rod 102 at one end and is wound around the rod. Rod 102, acting as a spool for strap 1, is provided with a retraction mechanism (not shown). The retraction mechanism can be any spring loaded retracting mechanism or any other retraction mechanism known in the art, such as are used with seat belts, measuring tapes and the like. For example, the retraction mechanism can comprise a spiral leaf spring having one end secured to rod 102 so as to present torque on the rod when strap 1 is withdrawn and to cause the strap to roll back once its free end is released. The upper end of rod 102 terminates with head 115 and a cap 116 of a larger diameter mounted on springs 118. The inner surface of cap 116 fits onto outer surface of head 115, such that when cap 115 is pressed downward, it locks head 115, preventing free rotation of rod 102 and consequently preventing strap 1 from being rolled or unrolled. The second free end of strap 1 terminates with buckle 111 which fits into a complementary accepting recess 142 of connector 145 for allowing quick connection into the second side of casing 25. In the example illustrated here, buckle 111 has an arrow shape while connector 145 has a complementary arrow shape recess 142 provided with slanted protrusions 144 mounted on springs 146. When buckle 111 (duplicated on the right side of FIG. 6 for description sake only) is pushed toward recess 142, protrusions 144 are pressed aside, and then fall behind the arrow head of buckle 111, locking the buckle. Movable connectors 105 and 145 are coupled to the machinery components by means of horizontal rods 106, which extend through openings 103 into central compartment 120 and are in contact with disk 128 perimeter. Horizontal rods 106 terminate with bearings 109 which allow the rods to smoothly slide along disk 128 perimeter as the disk revolves around its axis. Thus, the distance between rods 106, and consequently the periodical change of the circumference of the loop encircling the limb, mimics the outline shape of disk 128. In order to maintain constant contact between bearings 109 and disk 128 and to facilitate fast transition between strap relaxed to contracted position, rods 106 are mounted on biasing springs 108 positioned between walls 105 and are provided with plates 107 perpendicular to the rod axis and pressed against springs 108. Thus, springs 108 bias connectors 105 and 145 in the inward direction toward each other. As disk 128 revolves around its axis, springs 108 are compressed by plates 107 in accordance with disk 128 varying radius. When disk 128 rotates to the point where cusps 129 simultaneously face bearing 109, rods 106 momentarily lose contact with disk 128 and the potential energy stored in springs 105 is released, pushing rods 106 inwardly. This causes a sudden inward pulling of strap 1 by both rods 106, leading to sharp squeezing of the limb muscles. It will be easily realized that the length interval between contracted and released states of the limb encircling loop, and hence the squeezing force exerted on the muscles, is directly proportional to the radius change at cusp 129. Following the sudden strap contraction, the rods are gradually pushed outwardly leading to strap relaxed mode which lasts for substantially half a cycle. Hence, one revolution of disk 128 around its axis results in two fast strap contractions. Typically, the transition from relaxed to contacted position takes about 0.5 seconds, the transition from contracted to relaxed position takes about 5 seconds and the relaxed position is maintained for about 50 seconds. However, it will be easily realized that the perimeter of disk 128 can be shaped such as to obtain any desired contraction-relaxation cyclic pattern.

Figure 7:
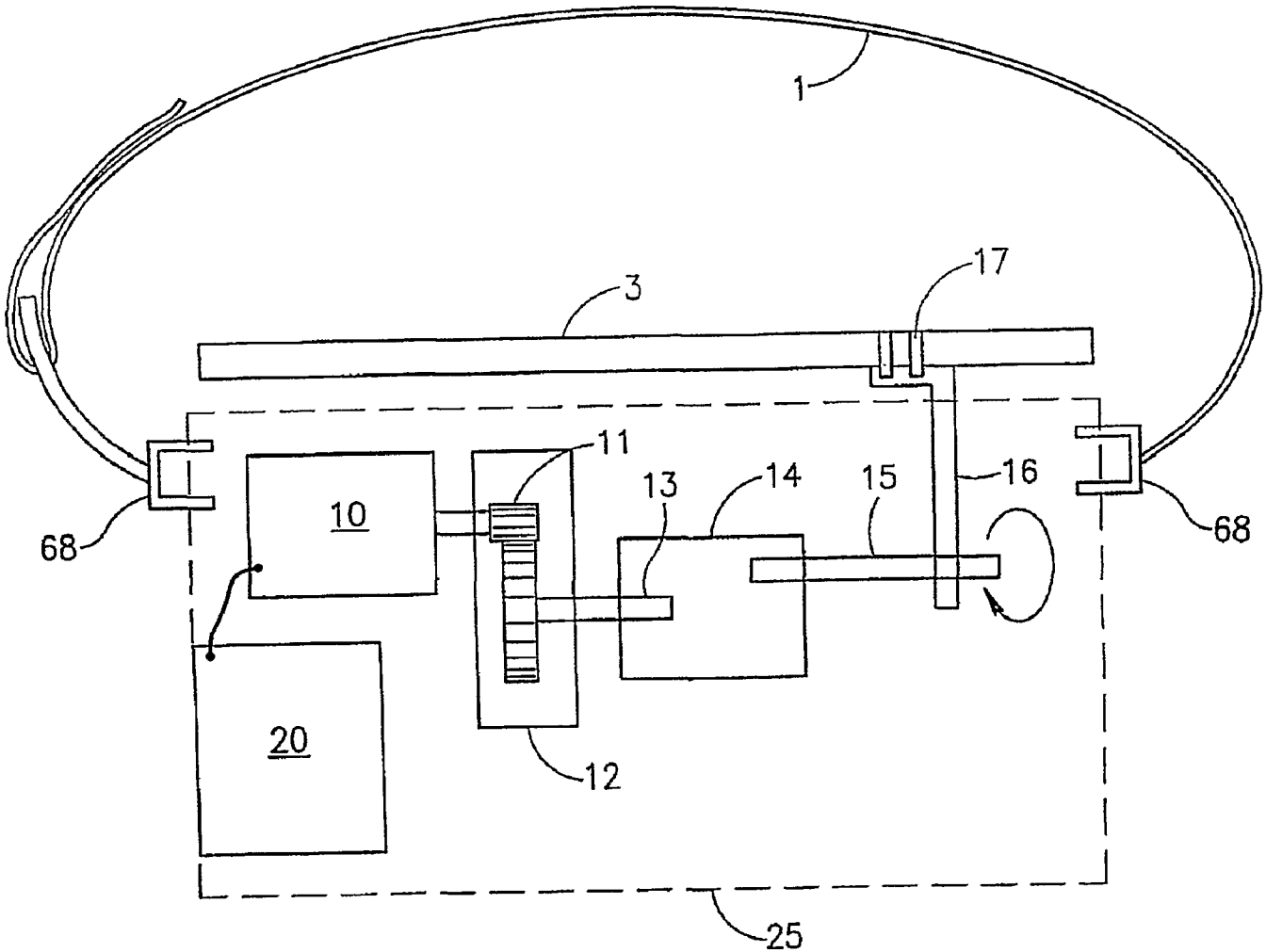
FIG. 7 is a top view of a device in accordance with the anterior box embodiment of FIG. 2B showing the internal mechanism of the assembly box.

The device is further provided with an on/off switch 130 comprising button head 132, electrical connector 134 made of electric conductive material, and a bottom protrusion 136. When switch 130 is pushed to the left by means of head 132, connector 134 closes the electric circuit (shown in broken line), setting the machinery into action. Simultaneously, protrusion 136 presses cap 116 downward, locking head 115 and preventing rod 102 from turning around its axis, for fixing the available length of strap 1. Button 132 can be further provided with a force regulator for regulating the frequency. A different embodiment of the present invention in which box assembly 2 is the active intermittent compressing part is depicted in FIG. 2B. According to this embodiment, assembly box 2 further comprises a compressing plate 3 lying substantially parallel to casing 25 at a predetermined distance from its surface. According to this embodiment, the assembly 2, more specifically said compressing plate 3 is pressed against the muscle and intermittently extend and retracts from casing 25 thus producing intermittent compression of the calf muscle. According to this embodiment strap 1 is connected to casing 2 by two fixed slited latches, such that at least one end of strap 1 is threaded through one of latches 68 and is folded onto itself to allow comfortable fitting, as described in conjunction to FIG. 2B. An on/off switch 6, a power regulator 5 and a rate regulator 7 are located at the top of the device in the same fashion as in FIG. 2B. A top view of a machinery embodiment in accordance with the device embodiment of FIG. 2B is shown in FIG. 7. A power source 20 powers an electrical motor 10 that has a centrally located shaft 11. Said centrally located shaft 11 is coupled to a velocity reduction gear 12 which reduces the spinning velocity of the rod 11 and increases the power output. Reduction gear 12 has a centrally located rod 13 that is connected to drum 14 that has an eccentric located rod 15. The eccentric located rod 15 is connected perpendicularly to the longer arm of a motion transfer L-shaped bar 16, wherein the shorter arm of said L-shaped bar 16 is connected to compressing plate 3 by connection means 17. Connection means 17 may be for example bolts, pins, screws etc. Electrical motor 10 converts electrical energy into kinetic energy stored in the spinning of the centrally located rod 11. The kinetic energy stored in the spinning of the said centrally located rod 11 is converted into power by the said velocity reduction gear 12. The power stored in the said centrally located rod 13 connected to the said velocity reduction gear 12 is converted to the rotation of the said drum 14 which has the said fitted eccentrically located rod 15. The circular motion of the said eccentrically located rod 15 is transferred to the extension and retraction of the said compressing plate 3 via the said motion transfer rod 16 and connection means 17. According to this arrangement, the circular motion of the eccentrically located rod 15 is transferred into periodical motion of plate 3. Said periodical motion of plate 3 is a combination of a first periodic motion in the extension-retraction direction (i.e., increasing and decreasing the distance between plate 3 and casing 25) as well as a second periodic motion which is perpendicular to said first periodic motion. (In accordance with FIG. 6, this second periodic motion is in a direction perpendicular to the drawing surface). Thus, further to the obvious effect of applying intermittent compression on the limb by the extension-retraction motion of plate 3, the present embodiment also imparts the device a "massage-like" effect, thus enhancing the squeezing efficacy. It will be easily realized by persons skilled in the art that the embodiments described in FIGS. 3-7 are only examples and that different features described separately in conjunction with a particular embodiment, can be combined in the design of a device of the present invention. For example, a retractable strap feature as illustrated in FIG. 6 can be combined with any of the other embodiments. Much the same, an asymmetrical component such as disk 128 of FIG. 6 can be added to any of the other embodiments for allowing a particular pattern of a contraction-relaxation cycle.

Figure 8:
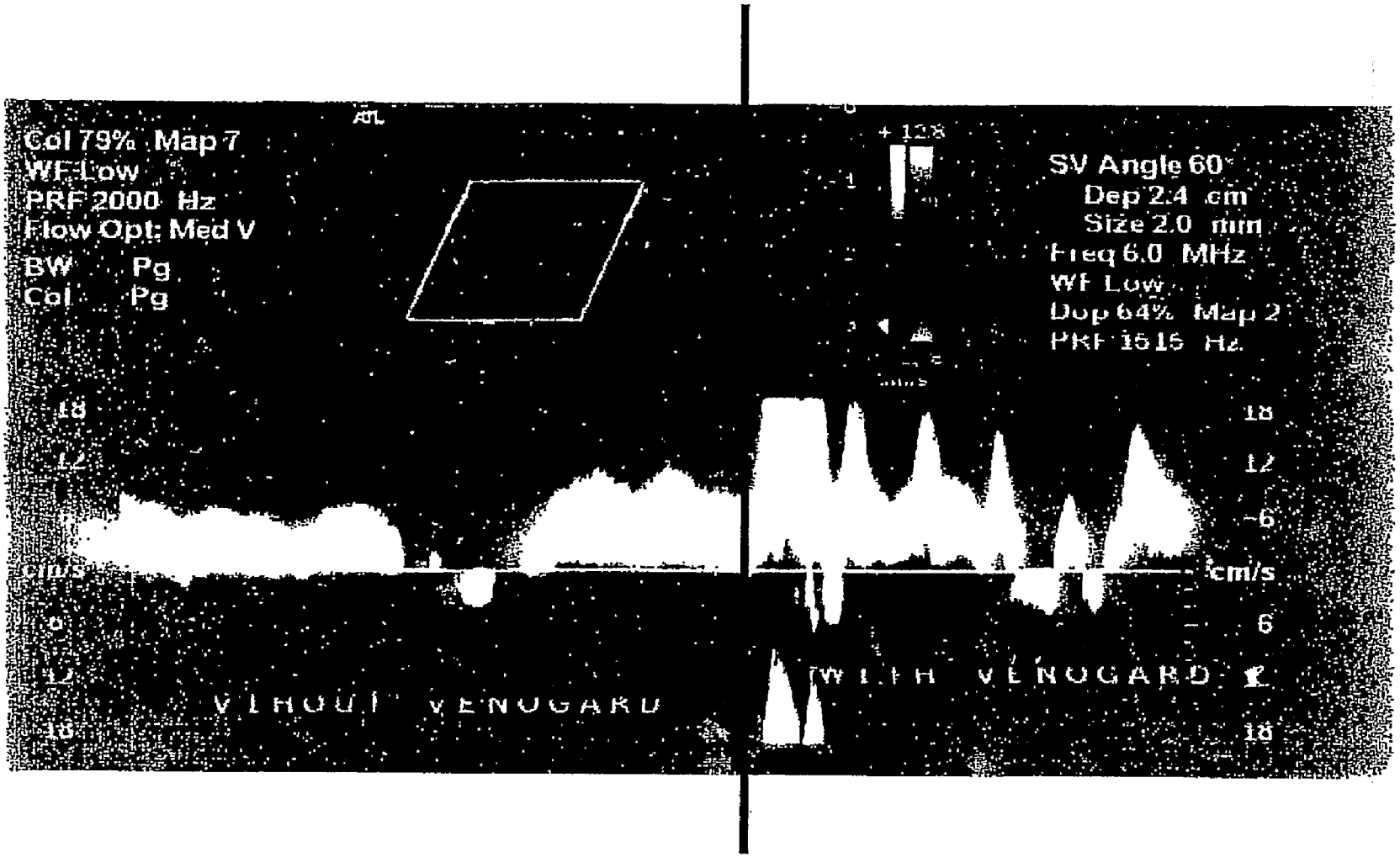
FIG. 8 shows exemplary Doppler ultrasound test results obtained by the application of the present invention.

FIG. 8 shows an exemplary Doppler ultrasound test results obtained by the application of the present invention. The results shown here were obtained by applying a device in accordance with the embodiment of FIG. 6 on a 49 years old healthy woman in the supine position. The device was applied to the right thigh close to the groin. The right side of FIG. 8 is a Doppler ultrasound measurement of the patient just before the activation of the said device. The white areas represent the blood flow in the deep veins of the thigh. These white areas are taken here as baseline for this subject. The blood flow in the deep veins of the same subject is illustrated in the left picture of FIG. 8 immediately after the said device was put to action. FIG. 8 clearly shows the immediate enhancement in the venous blood flow above the said baseline upon operation of the device as depicted by higher peaks of white areas. The above Doppler Ultrasound example displays the efficacy of the present device.

Figure 9:
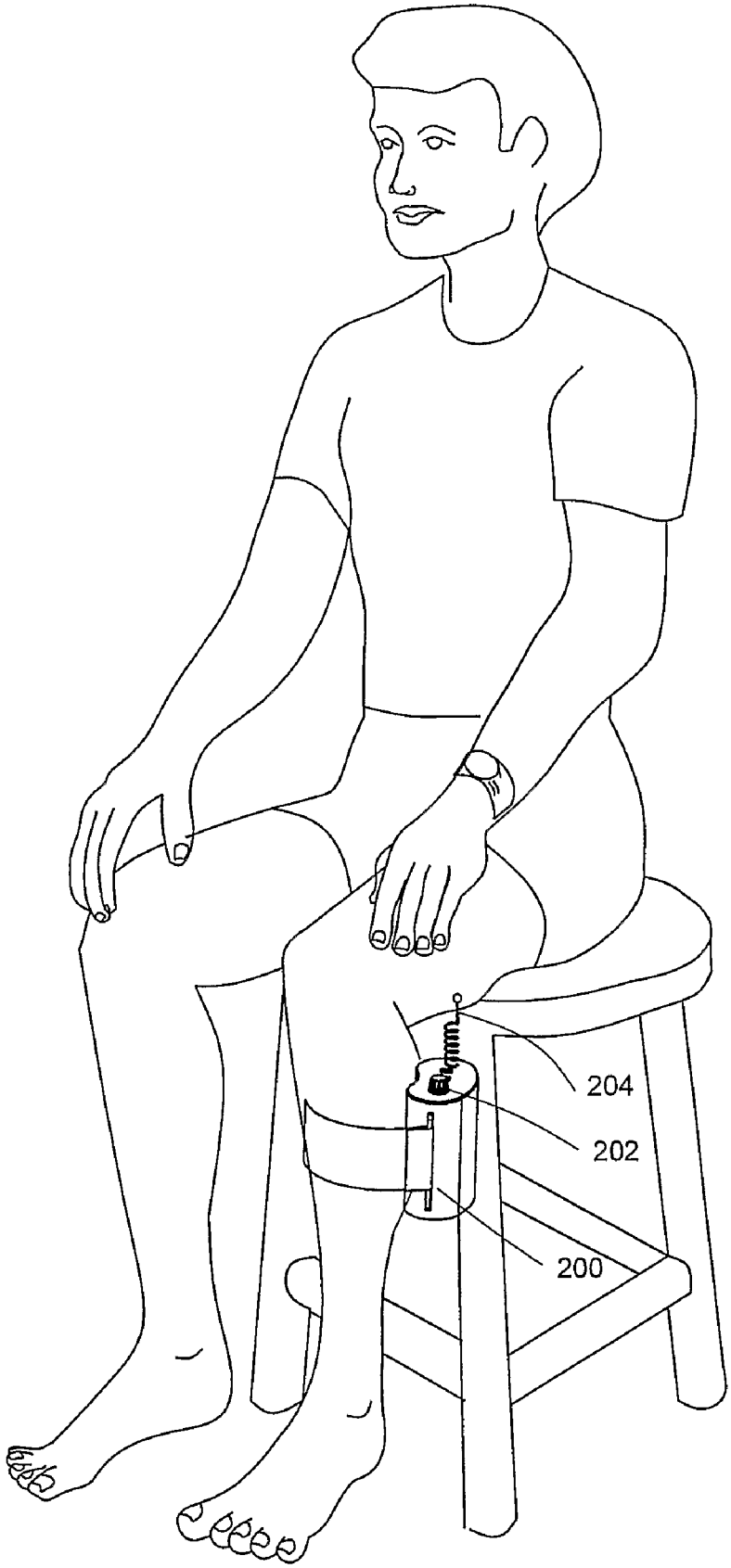
FIG. 9 is a pictorial illustration of the device of the present invention strapped to the calf of a sitting person where the device is equipped with sensor devices, a transceiver device, and an antenna device, in accordance with another preferred embodiment of the present invention.

FIG. 9 shows another preferred embodiment of the present invention that provides a device 200 that applies intermittent squeezing and releasing of the muscles of a user. Device 200 can be any of the devices depicted in the above description and appending drawings or in any of the other embodiments disclosed in related Israel Patent Application serial number 160185 filed on 2 Feb., 2004 titled "A PORTABLE DEVICE FOR THE ENHANCEMENT OF CIRCULATION OF BLOOD AND LYMPH FLOW IN A LIMB", Israel Patent Application serial number 160214 filed on 4 Feb., 2004 titled "A PORTABLE DEVICE FOR THE ENHANCEMENT OF CIRCULATION OF BLOOD AND LYMPH FLOW IN A LIMB" and co-pending U.S. patent application designated Ser. No. 10/469,685 titled "A PORTABLE DEVICE FOR THE ENHANCEMENT OF CIRCULATION AND FOR THE PREVENTION OF STASIS RELATED DVT", filed 3 Sep. 2003 with priority dated 5 Mar. 2001, and to PCT patent application filed concurrently and titled "A PORTABLE SELF CONTAINED DEVICE FOR ENHANCING CIRCULATION", the content of which is incorporated herein by reference.

As can be seen from the device 200 depicted in association with the description above and appending drawings as well as from the incorporated by reference applications, the device applies intermittent compression to a limb. The intermittent compression is applied via the use of a strap or flaps or a pressing element that provides pressure to the compressed limb. The compression is obtained through the use of one or more actuators that generate continuous intermittent movement of the compressing elements. The device 200 further includes one or more power generating devices such as a battery or a spring or the like. The device 200 is energy efficient in design providing an energy profile sufficient to enhance the lymph and blood flow in the limb. Thus, in operation the energy generating device generates or provides stored power which is fed to the actuator that in turn transforms the power to intermittent movements which are applied via the compressing elements to the limb of the user. The application of compressing force to the limb of the user generates squeezing forces which in turn assist in the flow of lymph or blood flow. As noted in the applications incorporated above by reference many other effects can be associated with the intermittent squeezing of the limb, including a suction effect which provides an effective return pressure in the limb assisting in the flow of venous blood in the limb. Still referring to FIG. 9, the device 200 can operates in accordance with sensor data generated by one or more sensors. The device 200 can work irrespective of sensor data collected. Preferably, the sensors are placed on the user's body. Alternatively the sensors are located within device 200 in the vicinity of the user's body or facing the user's body such that sensor data can be received and collected. As shown on the figure under discussion the device 200 is strapped to the calf of a sitting user. The mechanism used, could be fast release mechanism, fast pulling mechanism, normal/slow release mechanism, normal/slow pulling mechanism or a combination thereof or any of the incorporated by reference devices. In addition the power generating or storage device, the actuator and the squeeze/release mechanism and other mechanical components described, the device 200 includes one or more sensors (not shown). Optionally, the device 200 comprises further a transceiver device 202 and an antenna device 204. The sensors could be of differing types, measuring various body condition parameters, such as hear beat, blood-pressure, pulse, skin temperature, and the like. The sensors can be attached to the device wall facing the user's limb. Alternatively, the sensors can be applied to the strap or flap surrounding the circumference of the limb. While a housing is not an essential part of the invention, if a housing is used, the sensors can be internally placed within said housing preferably in close proximity to the body of the user. Yet, in another embodiment the sensors are attached to the user's limb or other organs independently and are associated with the device via a physical or wireless conduit. For example, a pulse sensor can be located on the wrist of the user, while the device 200 is attached to a lower limb of said user. The pulse sensor can be attached to the device 200 via a wire or via a wireless connection and transmit continuous data to the device 200 computerized processing unit, such as a microprocessor as to the pulse of the user during the activation of the device 200. Alternatively, the data can be transmitted every predetermined length of time, such as every few seconds or the like predetermined interval. If the sensors are located remote to the device 200, the sensor device will also comprise a power generating unit, such as a battery, a transmitter connected to the sensor and an antenna for transmitting the sensor data collected to the device 200 or to a remote device. The data generated by the sensors represent the above mentioned physical body condition parameters and therefore indicate the physical condition of the user. The sensors output electric/electronic signals, the strength or phase or frequency thereof represent the value of the measured body condition parameters. In the preferred embodiment, the signals are passed to a computing device such as a microprocessor to analysis and alternatively to a storage device for storage and later analysis or investigation. In an alternative preferred embodiment, the signals are fed to the transceiver device 202 and are transmitted from the transceiver 202 to the antenna 204. The antenna can be a Radio Frequency antenna. The antenna 204 broadcasts the signals via the air interface to a local or remote microprocessor (not shown). The computing unit (not shown) controls the mechanical operation of the device in accordance with the parameter values encoded in the signals transmitted. The control is implemented by the responses generated by the computing unit, such as the transmission of suitable commands from the computing unit to the device 200. Thus, in accordance with a pre-determined threshold value of one or more of the body parameters the operation of the device could be initiated, timed, suspended, paused or terminated. In an alternative embodiment the values of the signal received initiate or terminate a plan for the operation of the device 200. Such plans can include a sequence of operations to be performed by the compressing elements at a predetermined time, having varying parameters, such as level of compression, duration of compression, duration or intervals between a relaxation or squeezing steps, fast or slow release or compression of the compressing elements and the like. The threshold values are preferably set within the computing device and could be modified by the user or a person through providing commands to the device 200 via a remote computer. In the preferred operation of the device 200, data is received from the sensors. The data is transferred to the microprocessor, whether such microprocessor is located within device 200 or remotely, where the sensor data is analyzed and a determination can be made whether to provide a command to the device 200. Sensor data can be stored on a local or remote data storage devices (not shown) such as on a volatile or non-volatile storage device which can include a magnetic or mechanical or optical data storage devices, such as a Flash Memory, USB memory device, Magnetic Bubble Memory, disk storage, tape storage and the like. In one non-limiting example, the sensor attached to the device 200 is a blood pressure located in the vicinity of the device 200. Continuous blood pressure data gathered by said sensor associated with the user using the device is collected and is transferred for analysis. The microprocessor receiving said blood pressure data further includes a computer program embedded within the computing device which compares the blood pressure profile to a previously stored blood pressure profile of said user or to a previously stored blood pressure profile which is defined as the reference blood pressure profile. The blood pressure profile pre-stored in the computing device can represent a desirable blood pressure to be achieved by the operation of the device 200. The comparison between the accepted blood pressure profile of the user and the blood pressure profile which pre-stored can be performed for the purpose of assuring the device 200 is used safely and without exceeding the safety requirements for the treatment. Such profile can also be compared so as to provide an alarm to the user or a caregiver, whether local or remote as to deviation or departure from acceptable blood pressure profile. In accordance with another embodiment of the present invention, each use of the device 200 is accompanied by a recording session of the sensor attached or associated with device 200. The recording session includes the receiving of sensor data from the sensors attached or associated with the device 200 and their systematic recording on the storage device for later examination and analysis. Persons skilled in the art will appreciate that while the example above demonstrates the use of device 200 in association with a blood pressure sensor, any one or more other physiological data gathering sensors that can be used singularly or in combination, in like manner to achieve the objectives of the invention.

Figure 10:
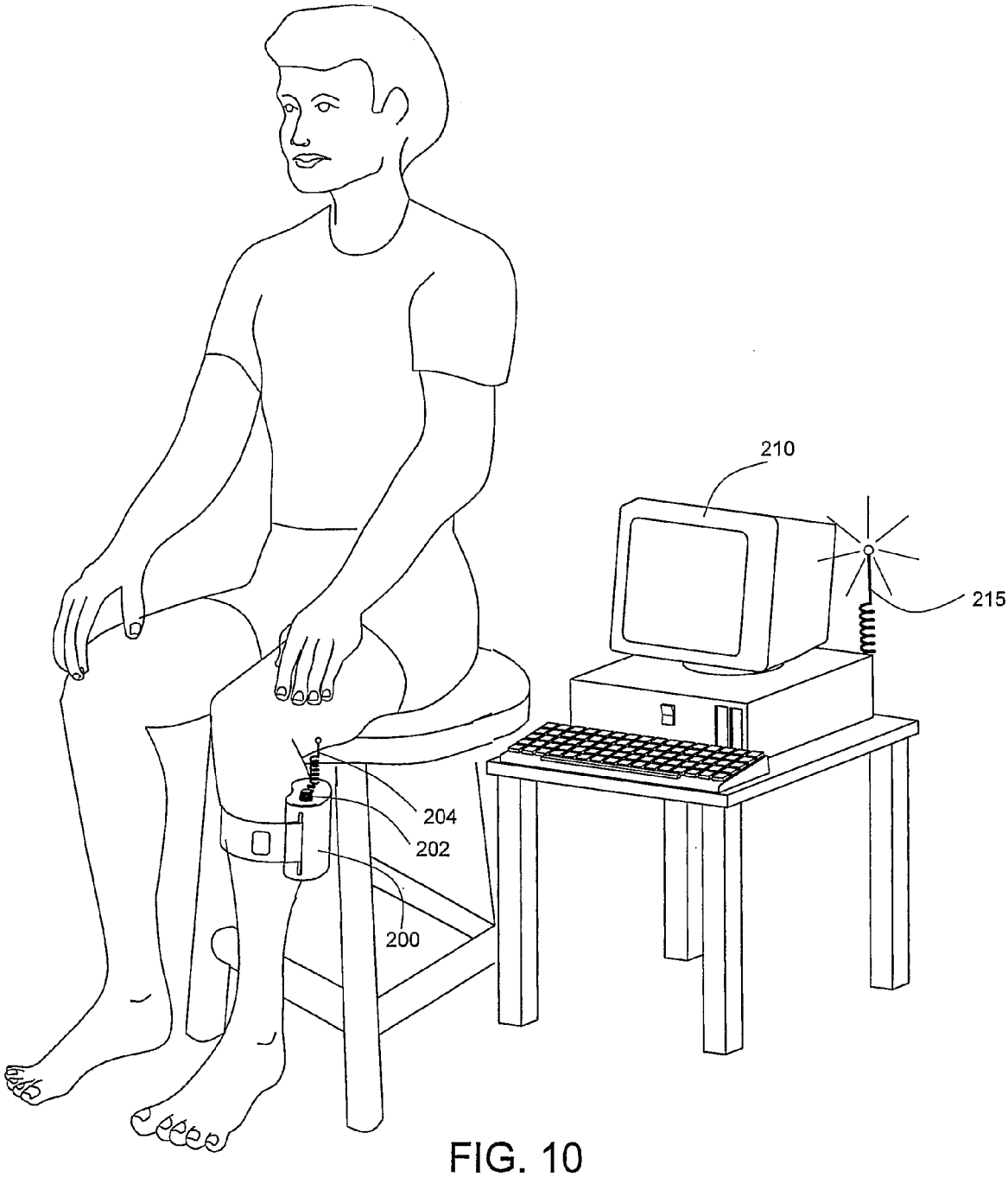
FIG. 10 is a pictorial illustration of the device of the present invention strapped to the calf of a sitting person where the device is equipped with sensor devices, a transceiver device and an antenna device, a computing device equipped with an antenna directed to receive the sensor-generated signals transmitted from the device of the present invention, in accordance with another preferred embodiment of the present invention.

FIG. 10 shows a more detailed view of the operative components constituting the additional preferred embodiment of the present invention as was introduced herein above in association with FIG. 9. As shown on FIG. 10 the device 200 is strapped to the calf of a sitting user. The device can also be worn on any other limb of the user, including the upper limbs. The device 200 includes one or more sensor devices (not shown), a transceiver device 202, a power source (not shown), and an antenna device 204. The housing of the device 200 includes one or more internally placed sensors (not shown) which are placed in close proximity to the body of the user. The sensors could be distal to the body of the user or could be proximate to the body of the user. The sensors could be of differing types, measuring various body condition parameters, such as heart beat, blood-pressure, blood volume flow, pulse, skin temperature, blood peak velocity, pulsability index, tissue perfusion, capillary flow, tissue metabolism, oxygen supply, oxygen consumption, $TCpO_2$, Tissue Laser Doppler, NOH levels, blood flow dilation or constriction, NADH, $CO_2$, blood vessel condition, vasoconstriction, vasodilation, muscle activity, neuronal activity, blood flow constriction, patient's daily activity, patient's walking distance, patient's heart rate, and the like. The data generated by the sensors represent the above mentioned physical body condition parameters and therefore indicate the physical condition of the user. The sensors output electric/electronic signals, the strength of or phase of or frequency of represent the value of the measured body condition parameters. The signals are fed to the transceiver device 202 and are transmitted from the transceiver 202 to the antenna 204. The antenna 204 broadcasts the signals in a wireless manner, such as through the use of radio frequency, via air interface to an antenna 212 of a microprocessor 210 embedded in a computing device. The microprocessor 210 controls the mechanical operation of the device 200 in accordance with the parameter values encoded in the signals transmitted. The control is implemented by the responses generated by the microprocessor 210 resulting in the wireless transmission of signals representing appropriate operating commands from the microprocessor 210 via the antenna 212 of the microprocessor to the device 200. The parameters comprising the device pressure profile, such as cycle, pressure level, pressure duration, rest period, and pressure gradient at transients, are determined in order to achieve a desired effect, such as desired flow during compression, desired flow during recovery, and desired blood pressure that are measured by a distal or a proximate sensor.

Figure 11:
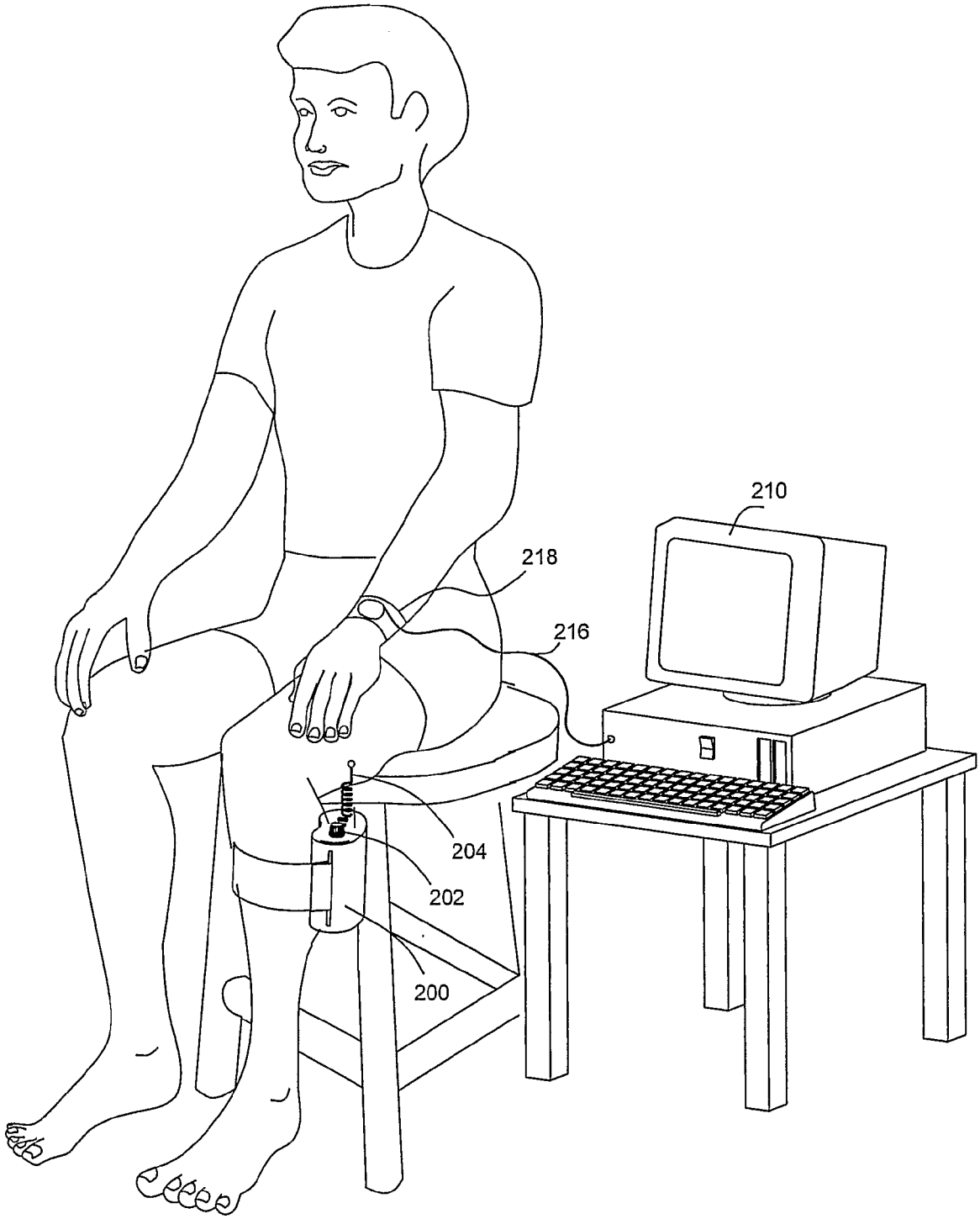
FIG. 11 is a pictorial illustration of the device of the present invention strapped to the calf of a sitting person where the device is equipped with sensor devices, a transceiver device, and an antenna device, the sensor device strapped to the wrist of the sitting person and linked to a computing device via a transmission line, in accordance with an another preferred embodiment of the present invention.

FIG. 11 shows yet another preferred embodiment of the present invention that provides a device 200 that applies intermittent squeezing and releasing of the muscles of a user and operates in accordance with sensor data generated by one or more sensors placed on the user's body. The device 200 operates according to the health condition of the user and provides safe use of the intermittent squeezing and releasing of the muscles for the user. As shown on the figure under discussion the device 200 is strapped to the calf of a sitting user. In addition to the housing, the squeeze/release mechanism, the straps or flaps and other mechanical components described herein above in association with the previous drawings and in association with the previous alternative embodiments, the device 200 includes one or more sensor devices (not shown), a transceiver device 202, a power source (not shown), and an antenna device 204. The housing of the device 200 includes one or more internally placed sensors (not shown) which are placed in close proximity to the body of the user. The sensors could be of differing types, measuring various body condition parameters, such as heart beat, blood-pressure, pulse, skin temperature, and the like. The data generated by the sensors represent the above mentioned physical body condition parameters and therefore indicate the physical condition of the user. The sensors output electric/electronic signals, the strength or phase or frequency thereof represent the value of the measured body condition parameters. The signals are fed to the transceiver device 202 and are transmitted from the transceiver 202 to the antenna 204. The antenna 204 broadcasts the signals via the air interface to a local or remote microprocessor (not shown). In addition to the sensors (not shown) installed in the device 200 additional sensors could be placed on suitable locations across the user's body. Thus, sensor 216 is shown strapped to the wrist of the user. By virtue of its location sensor 216 is capable of measuring the pulse of the user in an optimal manner. Sensor 216 is linked to the microprocessor 210 via a wired connection 218, such as a transmission cable. The microprocessor 210 controls the mechanical operation of the device 200 in accordance with the parameter values encoded in the signals transmitted in a wireless manner from the sensors located within the housing of the device 200 and in accordance with the parameter values encoded in the signals transmitted in a wired manner from the separate sensor 216. The control is implemented by responses generated by the microprocessor 210, such as the building and transmission of suitable commands from the microprocessor 210 to the device 200. Thus, in accordance with a pre-determined threshold value of one or more of the body parameters the operation of the device 200 could be initiated, timed, suspended, paused or terminated. The threshold values are set within the microprocessor 210 and could be modified by a user.

Figure 12:
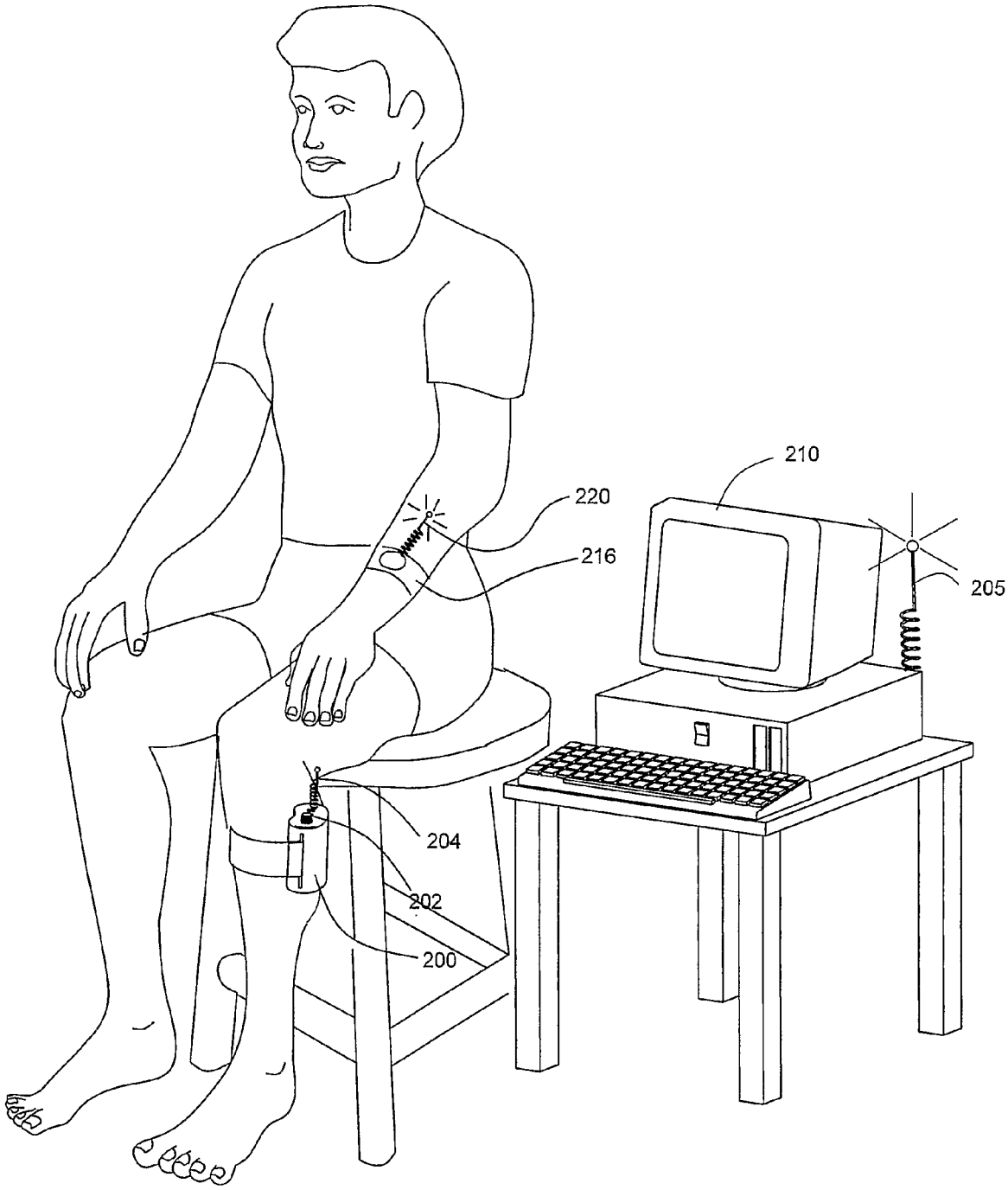
FIG. 12 is a pictorial illustration of the device of the present invention strapped to the calf of a sitting person where the device is equipped with sensor devices, a transceiver device, and an antenna device, a separate sensor device strapped to the wrist of the sitting person where the separate sensor device is equipped with a transceiver device and an antenna device and a computing device equipped with an antenna device directed to receive signals generated and transmitted by the separate sensor device strapped to the wrist of the sitting person, in accordance with another preferred embodiment of the present invention.

FIG. 12 shows a further preferred embodiment of the present invention that provides a device 200 that applies intermittent squeezing and releasing of the muscles of a user and operates in accordance with sensor data generated by one or more sensors placed on the user's body. The device 200 operates according to the health condition of the user and provides safe use of the intermittent squeezing and releasing of the muscles for the user. As shown on the figure under discussion the device 200 is strapped to the calf of a sitting user. In addition to the housing, the squeeze/release mechanism, the straps or flaps and other mechanical components described herein above in association with the previous drawings and in association with the previous alternative embodiments and applications incorporated herein by reference, the device 200 includes one or more sensor devices (not shown), a transceiver device 202, a power source (not shown), and an antenna device 204. The housing of the device 200 includes one or more internally placed sensors (not shown) which are placed in close proximity to the body of the user. The sensors could be of differing types, measuring various body condition parameters, such as heart beat, blood-pressure, pulse, skin temperature, and the like. The data generated by the sensors represent the above mentioned physical body condition parameters and therefore indicate the physical condition of the user. The sensors output electric/electronic signals, the strength or phase or frequency thereof represent the value of the measured body condition parameters. The signals are fed to the transceiver device 202 and are transmitted from the transceiver 202 to the antenna 204. The antenna 204 broadcasts the signals via the air interface to a local or remote microprocessor (not shown). In addition to the sensors (not shown) installed in the device 200 additional sensors could be placed on suitable locations across the user's body. Sensor 216 is shown strapped to the wrist of the user. By virtue of the appropriate location thereof sensor 216 is capable of measuring the pulse of the user in an optimal manner. Sensor 216 is linked to an associated antenna device 220. The antenna device 220 provides the establishment of a wireless link between the sensor device 216 and the microprocessor 210 via antenna 220, an air interface, and antenna 212. The microprocessor 210 controls the mechanical operation of the device 200 in accordance with the parameter values encoded in the signals transmitted. In a wireless manner from the sensors located within the housing of the device 200 via the antenna 204 and in accordance with the parameter values encoded in the signals transmitted in a wireless manner from the separate sensor 216 via the antenna 220. The control is implemented by responses generated by the microprocessor 210. The responses include as the building and transmission of suitable commands from the microprocessor 210 to the device 200. Thus, in accordance with a pre-determined threshold value of one or more of the body parameters the operation of the device 200 could be initiated, timed, suspended, paused or terminated. The threshold values are set within the microprocessor 210 and could be modified by a user.

FIGS. 10, 11, 12 presented a microprocessor 210 which preferably resides within a monitoring device. The monitoring device can be a portable monitor device or a non portable monitor device. The monitoring device having the capability to construct, manage, and store a detailed, multi-parametric, parameter values record of an individual's physiological parameters such as hear beat, blood-pressure, pulse, skin temperature. Any body condition monitored parameters that can be used for tracking and assessing patient/subject general health currently, over days, months, and years. The monitoring device includes a database and data management system linked with s/w receptors, each of which regularly collects various forms of data about or from a patient/subject. Non limiting preferred embodiment of the invention consists of three basic components; a data management system including the database; a plurality of physiological and subjective data collection components that collect a set of time stamped streams coming from the sensors (not shown) installed in device 200 or from additional sensors placed on suitable locations across the subject/patient body; and a communications system by which the data is periodically uploaded from and to the database.

The monitoring device constantly, on demand (upon request) or pre scheduled to monitor the multi parametric streams. The monitoring device preferably also includes a data logger that permits and/or prompts the patient to enter subjective reports of psychological and physiological data, as well as activities and environmental conditions. Thus, a composite stream (preferably serial) of objective physiological and subjective data is created which is indicative of the overall health history of a patient/subject. The monitoring device provides a diagnostic tool were the information data collected from the numerous sensors provides health indicators, each of which may have some relationship, or may be completely unrelated to, any particular medical condition. The composite multi-parametric data streams in combination when analyzed by the monitoring device provides enough information to allow the identification of a wide variety of possible trends, were in ensemble, may be indicative of any of a variety of medical conditions. The monitoring system can be configured to indicate diagnostic results as to pinpoint that the data collected is indicating a particular condition or more preferably configured and designed so that patterns which are characteristic of healthy subjects, as well as ill ones, can be derived from the collected data.

In yet another preferred embodiment the monitoring device collects a combination of sensed physiological data and subjective data entered by the patient. For subjective data collection, the patient-supplied data is solicited by the data logger using data prompts, which may be in the form of health-related questions. These questions may include interactive input formats such as patient body diagrams such as age, current weight or the like. As the data is collected, it is time stamped, compressed (where appropriate) and uploaded to the database, labeled for the patient in question. The resulting health history is a combined format of objective physical parameters and subjective patient data which is time-indexed for subsequent retrieval and analysis. From these stored data streams, trends in the data may be identified.

In the preferred embodiment, the subjective data logger runs a user-friendly data collection program which prompts the patient to report subjective data or simply serves to structure a voluntary submission of a report. This data is time stamped and stored in a local memory unit of the data logger for later uploading to the database. The management of storage may preferably chose to compresses the data parameters received from the monitored device and are capable to manage communications with external entities such as a any local or remotely located database server.

In a further preferred embodiment the captured parameters is selectively reduced by storing a series of time interval or amplitude pairs that comprise approximation of the compressed movement. I.e. storing only timing information for each beat and, once per minute, storing the median values of various components of a straight-line, the beat interval information is compressed by storing the differences in interval duration rather than the interval itself where possible, and storing the interval differences in formats which take advantage of their compressed size. In the preferred embodiment the monitor device can resides as a standalone computer based device with no connection to any network, or as a computer based device hardwired to a LAN or WAN or a as a computer based device using wireless connection or as a portable computer based device. In any of the configurations the monitoring computer device can continuously monitor the physiological parameters of the patient storing, managing, analyzing, building reports, draw statistics and the like. Once stored in the database, the data may be later accessed locally or remotely by an authorized physician or by the patient. Because the data is logged by patient and time-index, the data can be recovered for a particular patient and a particular time period with relative ease. The monitoring device is programmed as to read in real time a particular sensor and display an instant result but as discussed all patient history for example last monitored results logged, patient-supplied data, patient profile and the like are already stored in the database thus past data and current monitored data can be ensemble for identifying trends in healthy persons due to the fact that it is collected regularly, periodically in some cases irrespective of the patient's medical condition. In the preferable embodiment disclosed, the monitoring computer device further controls and supervises the mechanical operation of the sensor-based device for the intermittent squeezing and releasing of a muscle for the enhancement of blood and lymph flow in a limb and the prevention of DVT. The monitoring computer device controls the mechanical operation of the device in accordance with the parameter values encoded in the signal stream transmitted. The monitoring computer operates in accordance with a pre-determined threshold value of at least one of the body parameters thereby the operation of the device could be setup, initiated, timed, suspended, paused or terminated. The mechanical activation of the device can be scheduled, planed to be activated according to scheduling program. Such program can include a sequence of operation to be perform by for example the compressing elements at a predetermine time for a fix duration, recursively, randomly and the like. The thresholds values are preferably set in the computer monitoring device by the user or person via a dedicated s/w application. In yet another preferred embodiment a set of rules for alarm is defined as to activate and display alert notification to a responsible person. Alerts can be presented on the computer monitoring device screen or be sent to a remote computer. An example can be the subject's physician computer. Non limiting examples of such alarming conditions can be that the device being monitored has a malfunctioning component; result monitored exceeding predefined threshold boundaries, over heating situation and the like.

It should be apparent to the person skilled in the art that the monitoring computer device of the present invention is designed to be generically used for monitoring any sensor output data parameters whether it is generated by electrodes sensor, expansion sensor, accelerometer sensor, a microphone sensor, a barometric pressure sensor, an underarm temperature sensor, a pectoralis temperature sensor and an ambient temperature sensor or any other physiological monitoring sensor.

In addition to the examples shown above, it will be apparent to the person skilled in the art that the device of the present invention can be readily used for the enhancement of blood flow in many situations. Such include persons sitting or laying for long periods of time (for example, during long air flights or car travels or long hours working at the sitting position or immobilization at the hospital or rehabilitation center and the like.) It will be apparent that it may also be used for the enhancement of blood flow of a patient with diseases such as Diabetes Mellitus and Burger's disease. Also, for the enhancement of lymph flow in the hand of a patient post mastectomy. Other uses not described here above will be apparent to the person skilled in the art. Providing said examples is made for the purpose of clarity and not limitation.

Figure 13:
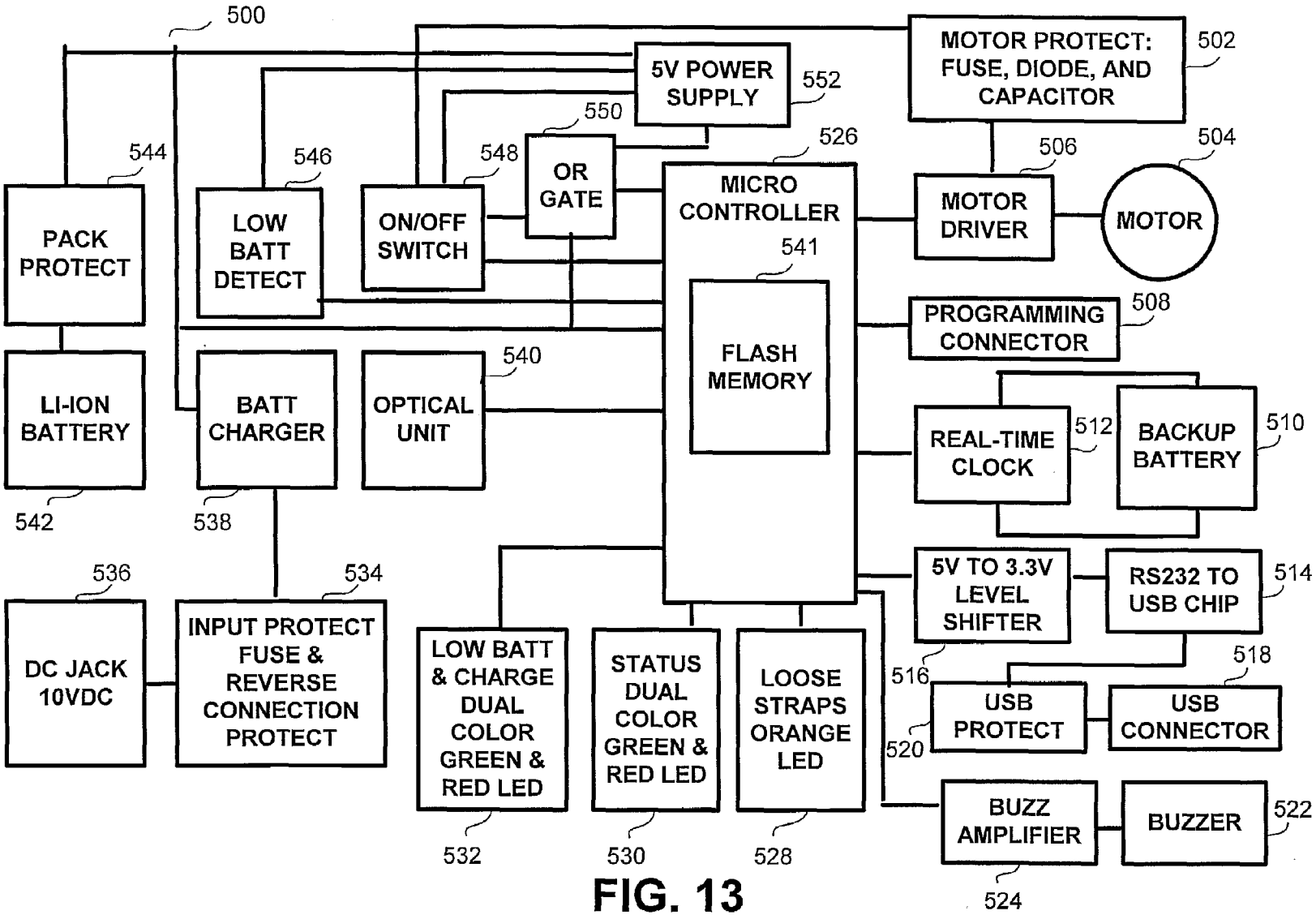
FIG. 13 is a simplified electrical block diagram showing the hardware components of the control system of the portable limb-mounted device, in accordance with a preferred embodiment of the present invention.

Referring now to FIG. 13 that shows the electrical control system 500 of the computerized portable device. The electrical control system 500 constitutes a set of diverse interconnected and functionally inter-related electronic components embedded suitably within the computerized portable device and provide in combination for the automatic or semi-automatic controlling of the regular or specific operational modes of the computerized portable device. Thus, the control system 500 is responsible for handling the charging of the battery, for communications with an external monitoring device, for running regular operations, and the like. The control system 500 further supports such routine functions as switching on and off the computerized portable device, identifying and preferably handling mechanical malfunction situations, and recognizing, indicating and selectively handling typical fault conditions, such as "battery low" and "loose straps". The control system 500 includes a microcontroller 528 having a flash memory 541, a 5V power supply 552, an OR gate 550, an on/off switch, a battery low detector 546, a pack protect 544, a Li-ion battery 542, a battery charger 538, an optical unit 540, and a motor protect 502 that includes a fuse, a diode and a capacitor. Note should be taken that in other preferred embodiment of the present invention the OR gate could be replaced by an AND gate, an XOR gate, a NOT gate, or the like. The optical unit includes a sensor for monitoring the operation of the portable device where the monitoring includes detecting a loose strap condition, a tight strap condition, a fault condition, or the like. The sensor is located opposite a rotating component that is coupled to a rotating element. The rotating element reflects the rotational movement of the rotating element. The rotating element is provided with a marker configured to be detected by the sensor. The sensor is an opto-meter that includes a light transmitter and a light detector. The marker is configured to block or unblock light passage between the light transmitter and light detector. The sensor is an optical reader and the marker is a line marked on the rotating element wherein the marker is configured to be detected by the optical reader. The control system 500 further includes a motor driver 506, a motor 504, a programming connector 508, a real-time clock 512, a backup battery 510, a 5 B to 3.3V level shifter 516, a communication converter, such as an RS232 to USB chip converter 514, a communication protector, such as a USB protector, 520, a communication connector, such as a USB connector 518, a buzzer (audio) amplifier 524, and a buzzer (audio) device 522. The control system 500 further includes three LED lights: a low battery and charge dual color green and red LED 532, a status dual color green and red LED 530, and a loose straps indicator orange color LED 528. The control system 500 yet further includes an input protector fuse and a reverse connection protector 534 and a DC jack 10V DC 536.

Still referring to FIG. 13 the structure, functionality, responsibility of the control system 500 and electrical and logical interconnections of the electrical circuits constituting the control system 500 will be described via the setting forth of the operation of the computerized portable device electronic control system 500. Whenever a user of the computerized portable device connects the 10V DC jack 536 to the computerized portable device the control system 500 enters into charging mode. The charging mode includes the following stages: a) the 10V DC jack is connected, b) the 5V power supply 552 receives a high signal through the OR gate 550 switching the gate on, c) the battery charger 538 sends a signal to the microcontroller 526 in order to notify it that the battery 542 is being charged, d) the microcontroller 526 enters into "charging" mode, e) the microcontroller lights the red charging LED 532 up to the point in time where the battery charger 538 notifies the microcontroller 526 that the charging had been completed, f) when the battery charger 538 has finished charging the battery 54, the microcontroller 526 lights the green LED 532 indicating that the charging had been completed 532, and g) when the user removes the 10V DC jack the system is switched off. When a user of the computerized portable device connects a USB cable between the computerized portable device and an external monitoring device, such as a Personal Computer (PC) or the like, the control system 500 enters the communication mode (USB and charger mode). The communication mode includes the following stages: a) the user connects the USB cable to the USB connector 518, b) the user sets the on/off switch 548 to the ON position, c) the 5V power supply 552 receives a high signal through the OR gate 548 switching the gate on, d) the microcontroller 526 latches the 5V power supply 552 on through the OR gate 550, e) the USB to RS232 chip 514 notifies the microcontroller 526 that an external monitoring device, such as a PC (not shown) is connected, f) the microcontroller 526 sounds the buzzer (audio device) 522, g) the microcontroller 526 flashes the Green Status LED 530, h) the microcontroller 526 responds to commands sent to it from the PC (not shown) via the RS232 to USB chip 514) the RS232 to USB chip 514 tells the microcontroller 526 when the USB cable is removed, j) the microcontroller 526 releases the latch holding the 5V power supply 552, and k) the 5V power supply 552 shuts down and thereby shutting down the entire system circuit.

Still referring to FIG. 13 the electrical control system enters the running mode when the user of the computerized portable device, such as a patient, decides to use the computerized portable device for treatment. In order to enter the running mode the user sets the on/off switch to the ON position 548 where neither the 10V DC jack 536 is connected nor the USB cable is connected to the USB connector 518. The running mode includes regular operations, switching operations and the operations associated with exceptional situations. During the regular operations the computerized portable device will work in a normal manner as long as the voltage of the battery 542 is above 7.3V, the computerized portable device is correctly placed on the patient's leg, and there are no mechanical faults associated with the operation or the structure of the computerized portable device. The regular operations include the following stages: a) the user sets the on/off switch 548 to the ON position, b) the 5V power supply 552 receives a high signal through the OR gate 550 switching the gate on, c) the microcontroller 526 latches the 5V power supply 552, d) the activity of neither the battery charger 538 nor the USB chip 514 is detected, e) the microcontroller sounds the buzzer (audio device) 522, f) the microcontroller 526 lights the green status LED 530, g) the microcontroller reads the current time and date from the real-time clock 512 and records the time and date in the flash memory 541 for subsequent download to the external monitoring device during a subsequent communication mode session, h) the microcontroller switches on the motor 504) the microcontroller 526 times the responses from the optical unit 540 where as long as these responses follow the timing rules, the computerized portable device is said to be operating normally. A more detailed description of the responses of the optical unit 540 and the associated timing rules is provided within the text of the related patent application entitled "A PORTABLE SELF CONTAINED DEVICE FOR ENHANCING CIRCULATION" which is incorporated herein by reference.

Still referring to FIG. 13 when the user sets the on/off switch 546 to the OFF position the computerized portable device begins an extended switching off process. First, the moving mechanism of the device is brought to its correct stopping position where the correct stopping position is identified via the optical unit 540 and a specific timer device (not shown). The motor 504 is switched off after a pre-defined number of seconds subsequent to the reaching of the moving mechanism to the correct stopping position. The switching off process includes the following stages: a) the user sets the on/off switch 548 to OFF position, b) the microcontroller 526 receives a high signal from the switch 548, c) the microcontroller 526 sounds the buzzer (audio device) 522, d) the microcontroller 526 waits until the mechanism in the correct stopping position, e) the microcontroller records the length of time of the operation in the flash memory 541 and records the identification of the switching-off entity (the user) in the flash memory 541 for subsequent downloading of the information to an external monitoring unit, such as a PC (not shown) in a subsequent communication mode session, f) the microcontroller 526 switches the motor 504 off, g) the microcontroller 526 sounds the buzzer 522, h), the microcontroller 526 releases the latch holding on the 5V power supply 552, and h) the 5V power supply 552 shuts down thereby shutting down the entire control system 500.

Still referring to FIG. 13 there are three exceptional situations potentially associated with the computerized portable device: a) mechanical malfunction, b) loose straps, and c) low battery. A mechanical malfunction is identified using the optical unit 540 and a timer (not shown). If a mechanical malfunction occurs, the moving mechanism will stop turning. The handling of the mechanical malfunction by the control system 500 includes the following stages: a) the microcontroller 526 times the responses from the optical unit 540, b) the time periods are identified to be longer than the pre-defined values, c) the microcontroller 526 shuts down the motor 504, d) the microcontroller flashes the red status LED 530, e) the microcontroller sounds the buzzer 522 in synch with the flashing of the red status LED 530, f) the microcontroller 526 records the length of the period of the operation as well as indication of the occurrence of the malfunction in order to allow for subsequent downloading to an external monitoring device, such as a PC (not shown) in a subsequent communication mode session, g) the user sets the on/off switch 548 to OFF, h) the microcontroller 526 receives a high signal from the on/off switch 548) the microcontroller sounds the buzzer 522, j) the microcontroller 526 releases the latch holding on the 5V power supply 522, k) the 5V power supply 552 shuts down thereby shutting down the entire control system 500.

Still referring to FIG. 13 in the loose straps situation if the straps are loose on a patient's leg or if the computerized portable device is switched on when not attached to the patient's leg, the straps will be pulled into the computerized portable device further than they should be pulled. The loose straps situation is identified by the optical unit 540 and a mechanical tag unit (not shown). The handling of the loose straps situation includes the following stages: a) the microcontroller 526 times the responses from the optical unit 540, b) the specific pre-defined indication associated with an optical signal is identified during a specific pre-defined operational period, c) the microcontroller 526 flashes the orange loose straps LED 528, d) the microcontroller sounds the buzzer 522, e) the microcontroller 526 waits until the moving mechanism is in the correct stopping position, e) the microcontroller 526 records the length of the period of operation in the flash memory 541 and the indication of the loose straps situation for subsequent downloading to the external monitoring device, such as a PC (not shown) in a subsequent communication mode session, f), the microcontroller 526 switches off the motor 504, and g) the microcontroller 526 continues to show and sound the loose straps alarms via the LED 528 and the buzzer 522, respectively, for a pre-defined period of time or until the user switches off the computerized portable device.

Still referring to FIG. 13 there are two low battery levels defined by the system: a) low battery high (7.3V), and b) low battery low (7.2V). During normal operation the low battery alarm will start to sound when the voltage of the battery falls below the low battery high level and the computerized portable device will switch itself off when the voltage of the battery falls below the low battery low level. When the device is switched on, if the battery is below the low battery high, the microcontroller 526 will not switch on the motor 504. Instead the microcontroller 526 will flash the red and green low battery LEDs 532 simultaneously for a pre-defined number of seconds prior to switching itself off. The battery is checked at one specific pre-defined point during the mechanical cycle. This point is known as the battery testing point. The handling of the low battery situation includes the following stages: a) the microcontroller 526 waits for the moving mechanism to reach the battery testing point, b) the low battery detector 546 measures the voltage on the battery 542, c1) if the battery 542 is below the low battery high level then: 1) the microcontroller 526 flashes the red and green low battery LEDS 532 simultaneously, 2) the microcontroller sounds the buzzer 522, 3) the microcontroller 526 continues regular operation, c2) if the battery voltage is below the low battery low level then: 4) the microcontroller 526 waits until the moving mechanism is in the correct stopping position, 5) the microcontroller 526 records the length of the period of the operation in the flash memory 541 and the indication for low battery situation for subsequent downloading to a monitoring device, such as a PC (not shown) in a subsequent communication mode session, 6), the microcontroller 526 switches off the motor 504, 7) the microcontroller 526 sounds the buzzer 522, 8) the microcontroller releases the latch holding on the 5V power supply 552, and 9) the 5V power supply shuts down thereby shutting down the entire control system 500.

Referring now to FIGS. 14 through 22 that show the operational flowchart representing the order of execution of a set of computer instructions embedded in the microcontroller of the computerized portable device. The set of instructions generate a logical flow, the functionality of which is to control the operations of the computerized portable device. The instructions generate specific command signals that activate, de-activate and generally control the various electrical circuits constituting the control system of the computerized portable device. The flowchart further includes graphical indicators presenting the results of the instructions, such as the performance of specific mechanical and electronic operations, operational mode changes, results of operations, such as optical and aural indications, and the like.

Figure 14:
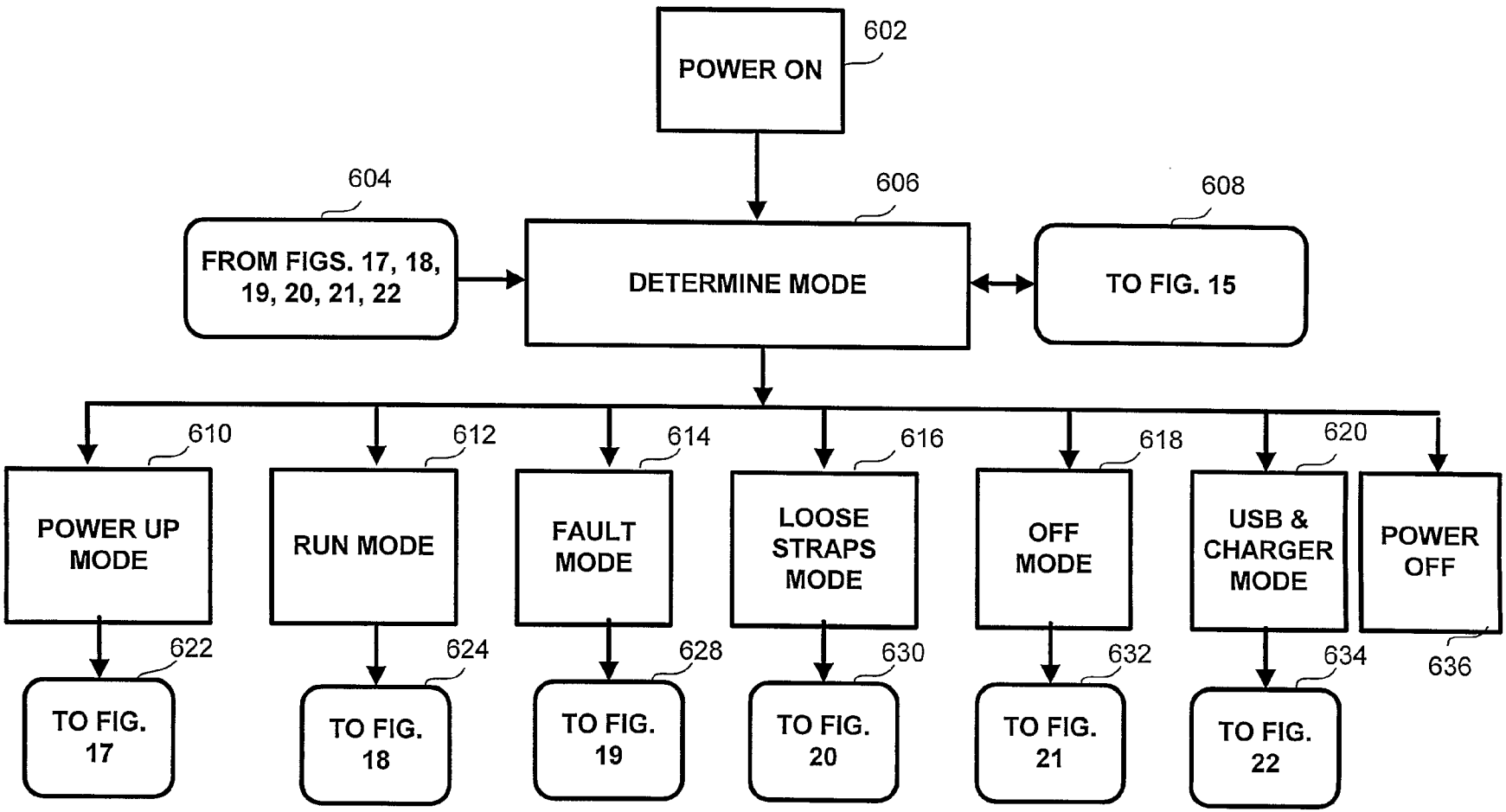
FIGS. 14-22 are flowcharts that show the order of execution of several sets of computer instructions constituting a computer program logic and associated sub-routines embedded in the microcontroller of the portable limb-mounted device.

Referring now specifically to FIG. 14 that shows a flowchart of the main logic sequence of a computer program implemented within the microcontroller. The computer program is responsible for the activation, de-activation and control of the control system of the portable device. At step 602 the computerized portable device is powered on. At step 606 the device enters a specific operational mode referred to as "determine mode". Determine mode is performed in order to determine the current operational mode of the device in accordance with specific pre-defined hardware-based indicators. A detailed description of the operations associated with the determine mode will be described herein under in association with the following drawings. In order to perform "determine mode" program control of the main logic sequence passes to step 608 and returns the current operational mode to step 606. In accordance with received current operational mode diverse mode-specific operations are executed. Thus, if it is determined that the device is in "power up mode" 610 then program control advances to step 622 for the performance of a set of suitable operations associated with the power up mode. Similarly the determination of run mode 612, fault mode 614, loose straps mode 616, off mode 618, and communication mode (USB & charger mode) 620 will effect the progress of program control to steps 624, 628, 630, 632, and 634, respectively in order to perform sets of mode-specific operations associated with the determined modes. Consequent to the running of the mode-specific operations the program control loops back from the various mode operations (step 604) and returns to 606 for repeating the determine mode-specific operations. The device enters power off mode and thereby it is switched off at step 636.

Figure 15:
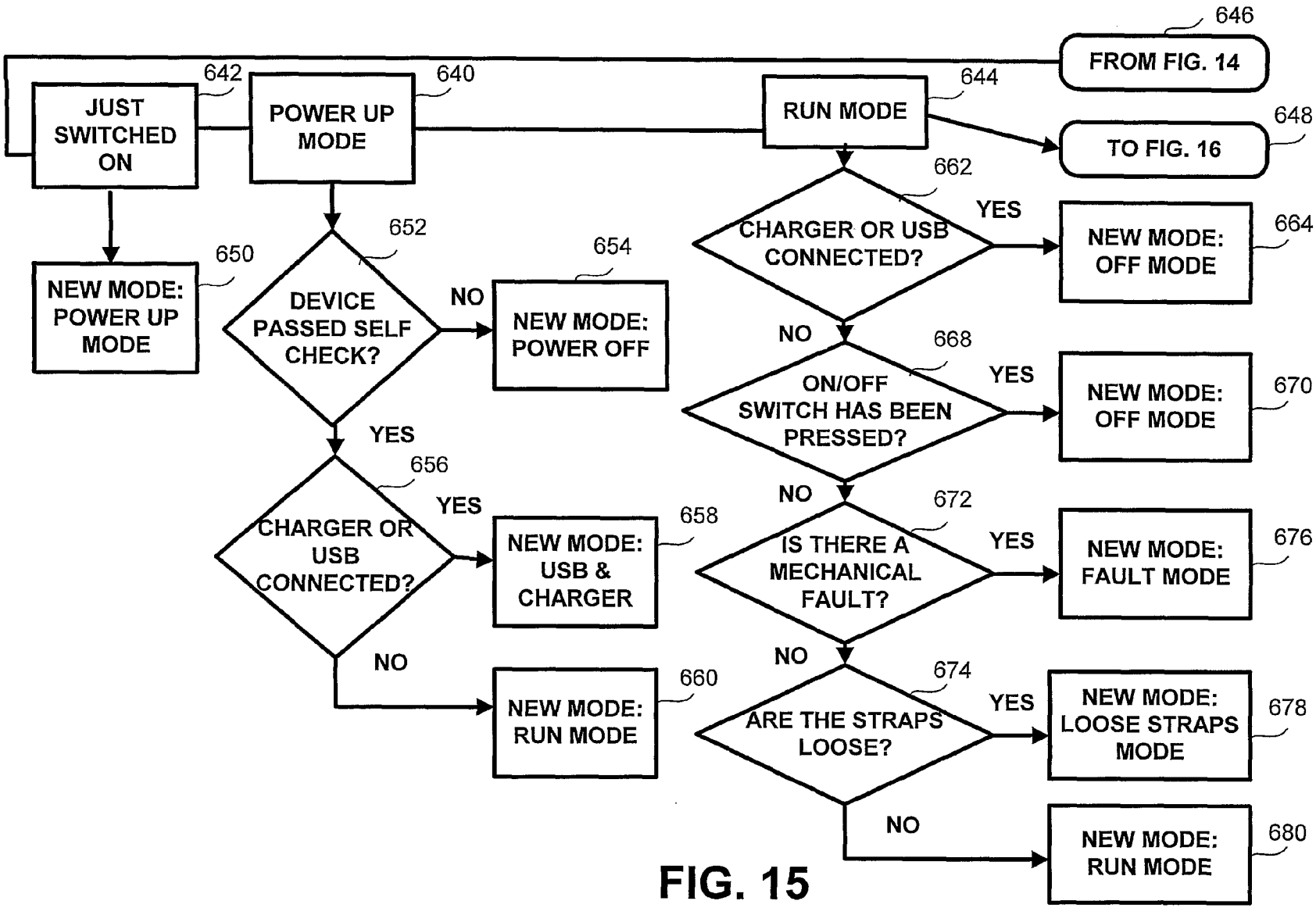

Referring now to FIG. 15 if at step 642 it is determined that the computerized portable device was just switched on then at step 650 the device enters power up mode. When at status-step 640 the device is in power up mode then at decision-step 652 it is determined whether the device passed self-check. If the result of decision-step 652 is negative then at action-step 654 the device enters power off mode. In contrast, if the result of decision-step 652 is positive then at decision-step 656 it is determined whether a battery charger or a USB cable is connected to the device. If the result of decision-step 656 is positive then at action-step 658 the device enters communication mode (USB & charger mode). In contrast, if the result of decision-step 656 is negative then at action-step 660 the device enters run mode.

Still referring to FIG. 15 at status-step 644 the device is in run mode. At decision-step 662 it is determined whether a charger or a communication cable, such as a USB cable, is connected to the device. If the result of decision-step 662 is positive then at action-step 664 the device enters off mode. Else if the result of decision-step 662 is negative then at decision-step 668 it is determined whether the on/off switch has been pressed. If the result of decision-step 668 is positive then at action-step 670 the device enters off mode. Else if the result of decision-step 668 is negative then at decision-step 672 it is determined whether there is a mechanical fault in the device. If the result of decision-step 672 is positive then at action-step 676 the device enters fault mode. Else if the result of decision-step 672 is negative then at decision-step 674 it is determined whether straps are loose. If the result of decision-step 674 is positive then at action-step 678 the device enters loose straps mode. Else if the result of decision step 674 is negative then at action-step 680 the device enters run mode.

Figure 16:
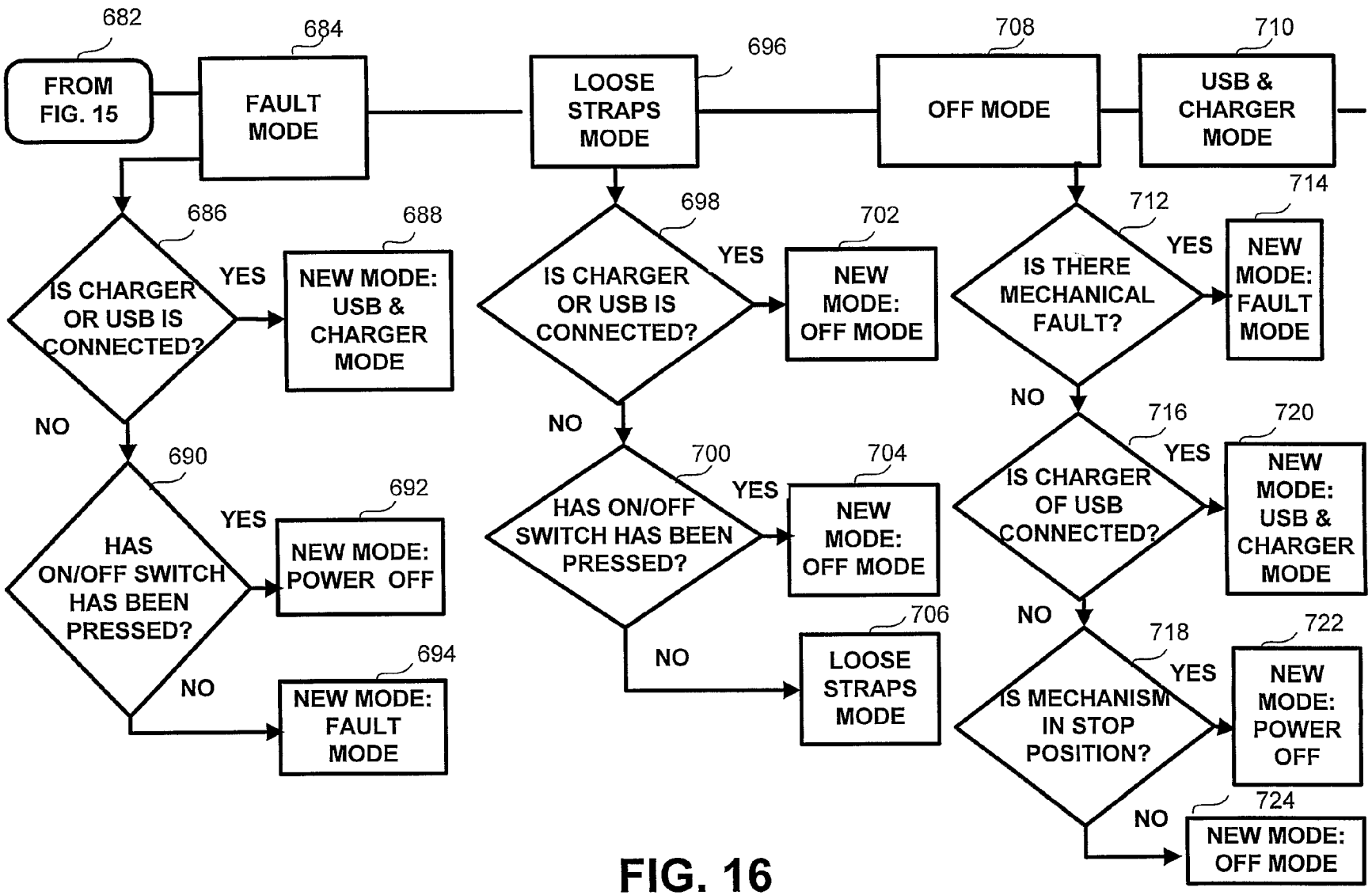

Referring now to FIG. 16 when at status-step 686 the computerized portable device is in fault mode then at decision-step 686 it is determined whether the charger or the communication cable, such as the USB cable, is connected to the device. If the result of decision-step 684 is positive then at action-step 688 the device enters communication mode (USB & charger mode). In contrast, if the result of decision-step 684 is negative then at decision-step 690 it is determined whether the on/off switch has been pressed. If the result of decision-step 690 is positive then at action-step 692 the device enters power off mode. In contrast, if the result of decision-step 690 is negative then at action-step 694 the device enters fault mode. When at status-step 696 the computerized portable device is in loose straps mode then at decision-step 698 it is determined whether the charger or the USB cable is connected to the device. If the result of decision-step 698 is positive then at action-step 702 the device enters off mode. In contrast, if the result of decision-step 698 is negative then at decision-step 700 it is determined whether the on/off switch has been pressed. If the result of decision-step 700 is positive then at action-step 704 the device enters off mode. In contrast, if the result of decision-step 700 is negative then at action-step 706 the device enters loose straps mode. When at status-step 708 the computerized portable device is in off mode then at decision-step 712 it is determined whether there is a mechanical fault associated with the device If the result of decision-step 712 is positive then at action-step 714 the device enters fault mode. In contrast, if the result of decision-step 712 is negative then at decision-step 716 it is determined whether a charger or a USB cable is connected to the device. If the result of decision-step 712 is positive then at action-step 704 the device enters communication (USB & Charger) mode. In contrast, if the result of decision-step 716 is negative then at decision step 718 it is determined whether the moving mechanism of the device is in correct stopping position. If the result of decision-step 718 is positive that at action-step 722 the device power off straps mode. Else if the result of decision step 718 is negative then at action step 724 the device enters off mode. When at status-step 710 the computerized portable device is in communication (USB & Charger) mode then in a consequent decision-step (not shown) it is determined whether the charger or the USB cable is connected to the device. If the result of the consequent decision-step (not shown) is negative then at a consequent action-step (not shown) the device enters power off mode. In contrast, if the result of the consequent decision-step (not shown) is positive then at a consequent action-step (not shown) the device enters communication (USB & Charger) mode.

Figure 17:
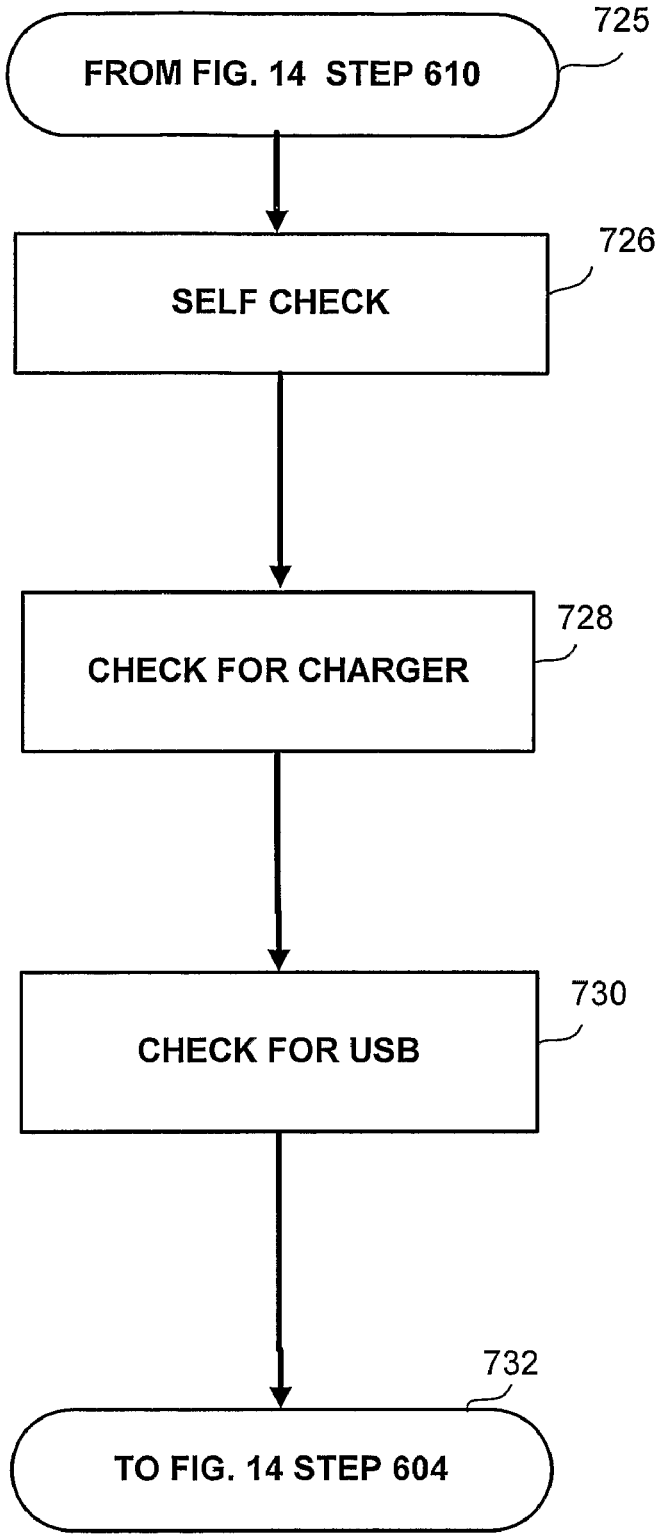

FIG. 17 shows a simplified flowchart illustrating the operations performed by a sub-routine which implements a set of computer instructions called for and executed by the main logic sequence of the computer program embedded in the microprocessor subsequent to the determination that the computerized portable device is in the power up mode. At step 725 program control activates the power up mode sub-routine. At step 726 the sub-routine instructs the control system to perform a self-check on the device. At step 728 the sub-routine instructs the control system of the device to check for a connected charger device. At step 730 the sub-routine instructs the control system of the device to check for a connected USB cable. Note should be taken that during the execution of the steps described above the operational mode of the device could change. Therefore, at step 732 the sub-routine's program control loops back to the main logic sequence of the computer program in order to enter the specific "determine mode" and to determine the current operational mode the device.

Figure 18:
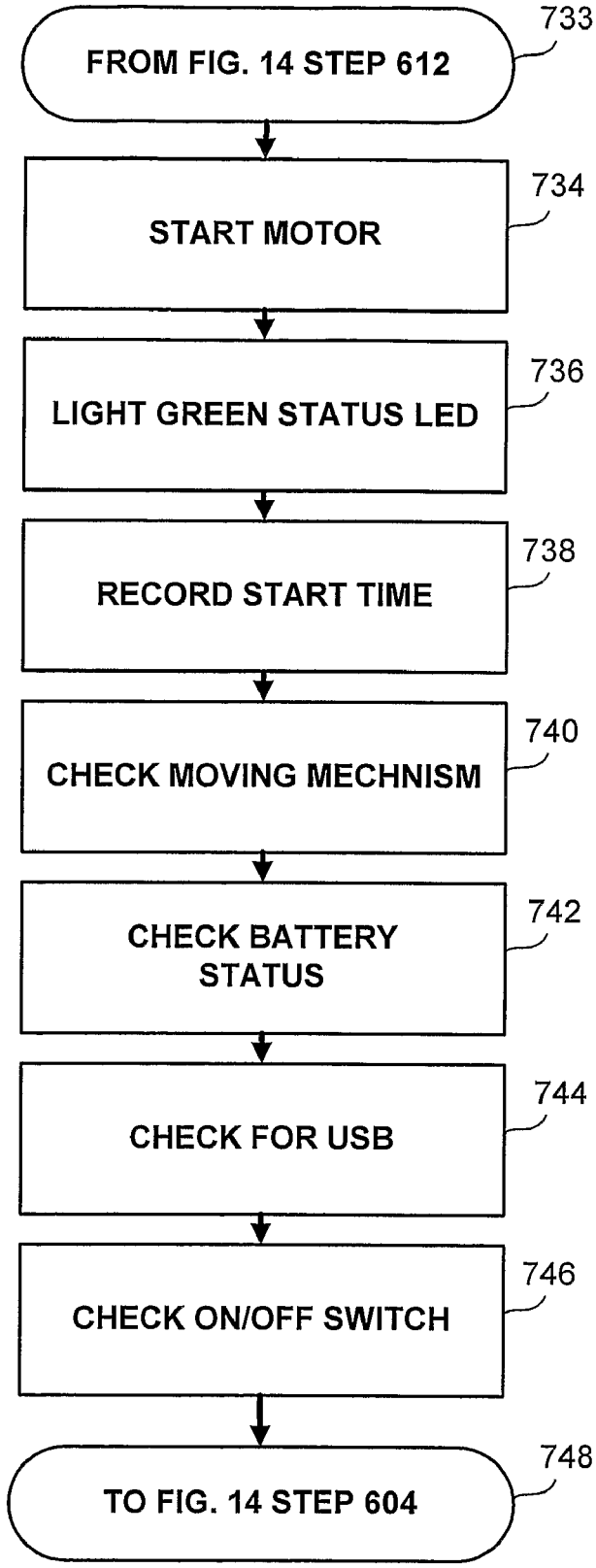

FIG. 18 shows a simplified flowchart illustrating the operation of a sub-routine that implements a set of computer instructions called for and executed by the main logic of the computer program embedded in the microprocessor subsequent to the determination that the device is in the run mode. At step 733 program control activates the run mode sub-routine. At step 734 the sub-routine issues a command to start up the motor of the computerized portable device. At step 736 the green status LED is lit and at step 738 the start time of the motor is recorded within the flash memory of the microprocessor. At step 740 the sub-routine instructs the control system to check the moving mechanism and at step 742 the sub-routine issues a command to the control system of the device to check the status of the battery. At step 744 the sub-routine instructs the control system to check whether a USB cable is connected to the device and at step 746 the position of the on/off switch is checked. Note should be taken that during the execution of the steps described above the operational mode of the device could change. Therefore, at step 748 program control loops back to the main logic sequence of the program in order to enter the specific "determine mode" and to determine the current operational mode the device.

Figure 19:
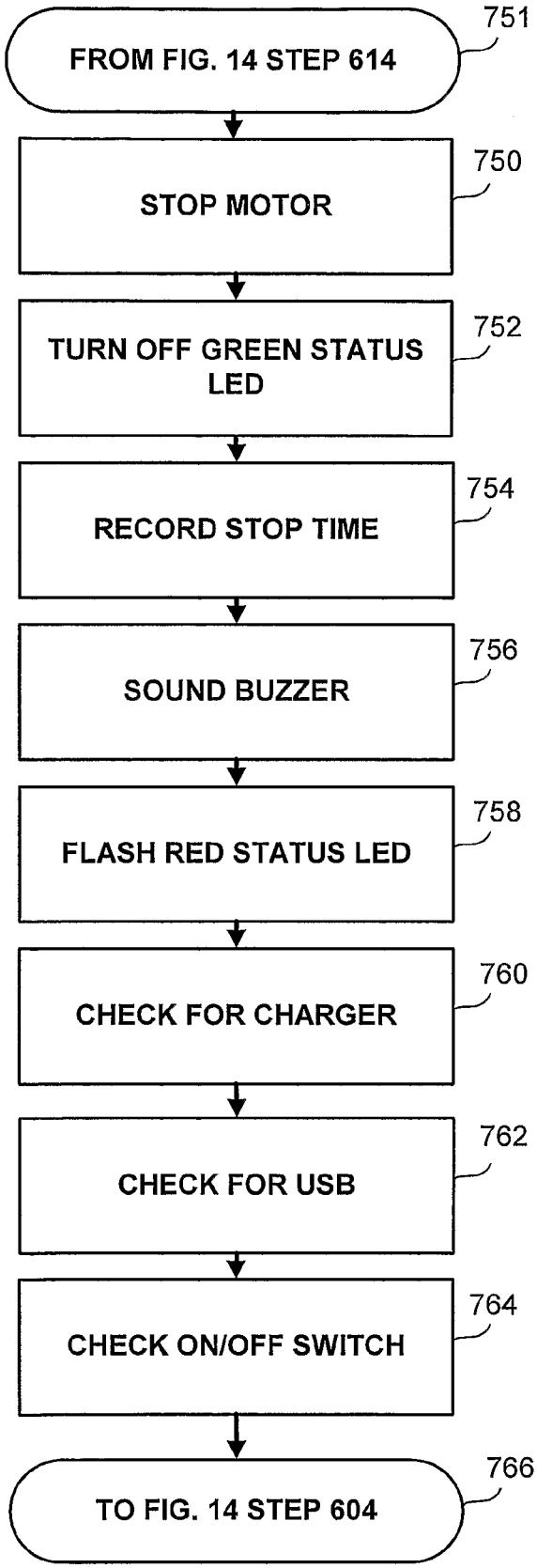

FIG. 19 shows a simplified flowchart illustrating the operation of a sub-routine that implements a set of computer instructions called for and executed by the main logic of the computer program embedded in the microprocessor subsequent to the determination that the device is in the fault mode. At step 751 program control activates the fault mode sub-routine. At step 750 the sub-routine issues a command to stop the motor of the computerized portable device. At step 752 the green status LED is turned off and at step 754 the stop time for the operation of the motor is recorded within the flash memory of the microprocessor. At step 756 the sub-routine instructs the control system to sound the buzzer device and at step 758 the red status LED is flashed. At step 760 the sub-routine instructs the control system to check whether a charger device is connected to the device and at step 762 a USB cable connection is checked. At step 764 the position of the on/off switch is checked. Note should be taken that during the execution of the steps described above the operational mode of the device could change. Therefore, at step 766 program control loops back to the main logic sequence of the program in order to enter the specific "determine mode" and to determine the current operational mode the device.

Figure 20:
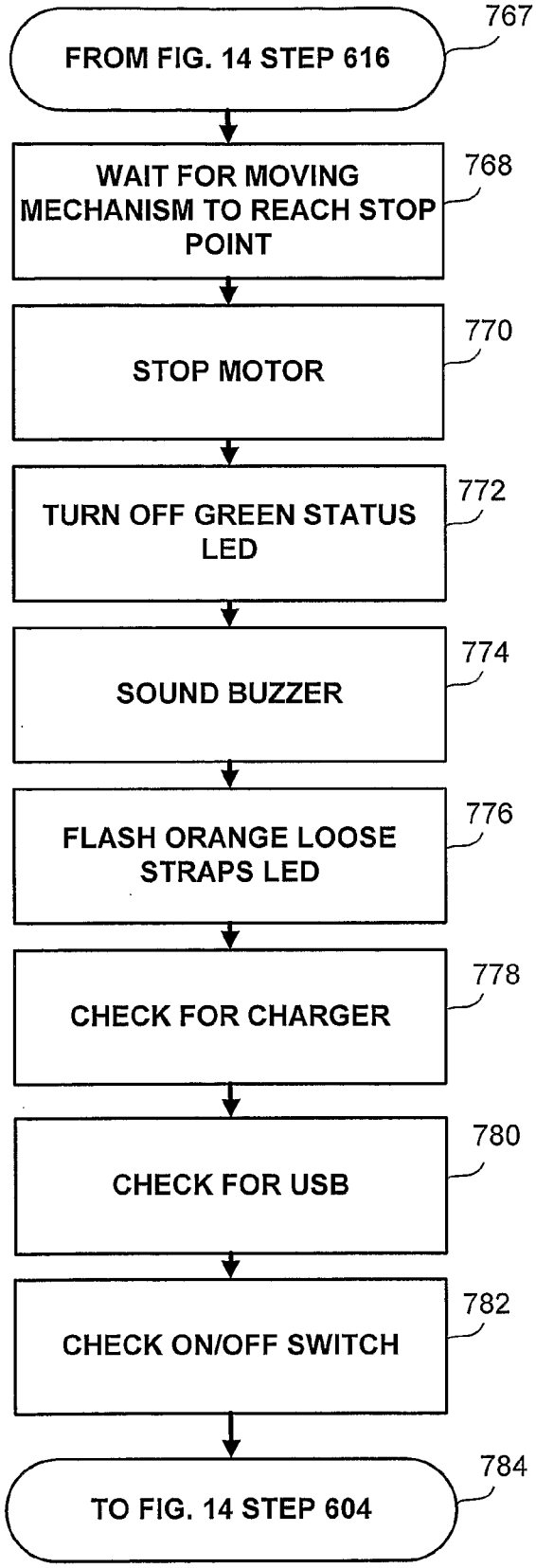

Referring now to FIG. 20 a simplified flowchart is shown that represents the logical flow of a sub-routine that implements a set of computer instructions called for and executed by the main logic of the computer program embedded in the microprocessor subsequent to the determination that the device is in the loose straps mode. At step 767 program control activates the loose straps mode sub-routine. At step 768 the sub-routine enters a wait state until the moving mechanism reaches the correct stopping position. At step 770 the sub-routine issues a command to stop the motor of the computerized portable device. At step 772 the green status LED is turned off and at step 774 the buzzer is activated in order to produce a buzzing noise for a pre-determined number of seconds. At step 776 the orange loose straps LED is flashed. At step 778 the sub-routine instructs the control system to check whether a charger device is connected to the device, then at step 780 a USB cable connection is checked and consequently at step 782 the position of the on/off switch is checked. Note should be taken that during the execution of the steps described above the operational mode of the device could change. Therefore, at step 784 program control loops back to the main logic sequence of the program in order to enter the specific "determine mode" and to determine the current operational mode the device.

Figure 21:
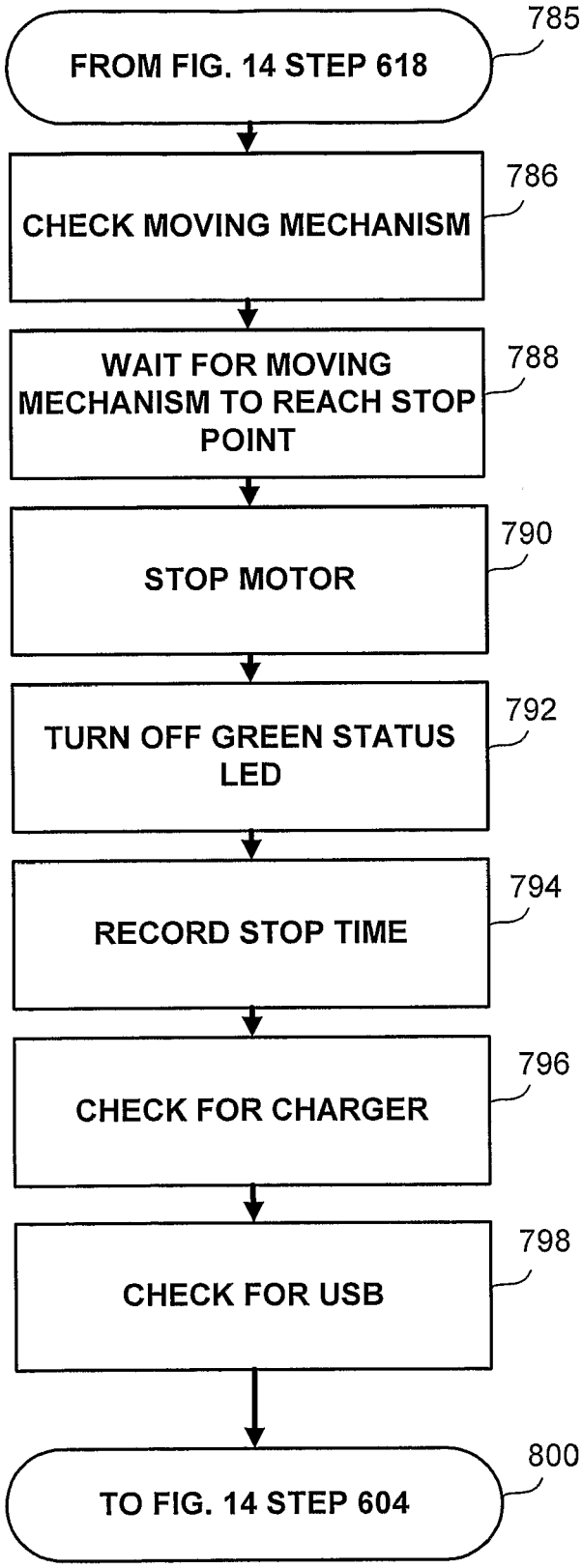

Referring now to FIG. 21 a simplified flowchart is shown that represents the logical flow of a sub-routine that implements a set of computer instructions called for and executed by the main logic of the computer program embedded in the microprocessor subsequent to the determination that the device is in the off mode. At step 785 program control activates the off mode sub-routine. At step 786 the sub-routine issues an instruction to check the moving mechanism and at 788 the sub-routine enters a wait state until the moving mechanism reaches the correct stopping position. At step 790 the sub-routine issues a command to stop the motor of the computerized portable device. At step 792 the green status LED is turned off. At step 794 the stop time of the motor is recorded into the flash memory of the microprocessor. At step 796 the sub-routine instructs the control system to check whether a charger device is connected to the device, and at step 798 a USB cable connection is checked. Note should be taken that during the execution of the steps described above the operational mode of the device could change. Therefore, at step 800 program control loops back to the main logic sequence of the program in order to enter the specific "determine mode" and to determine the current operational mode the device.

Figure 22:
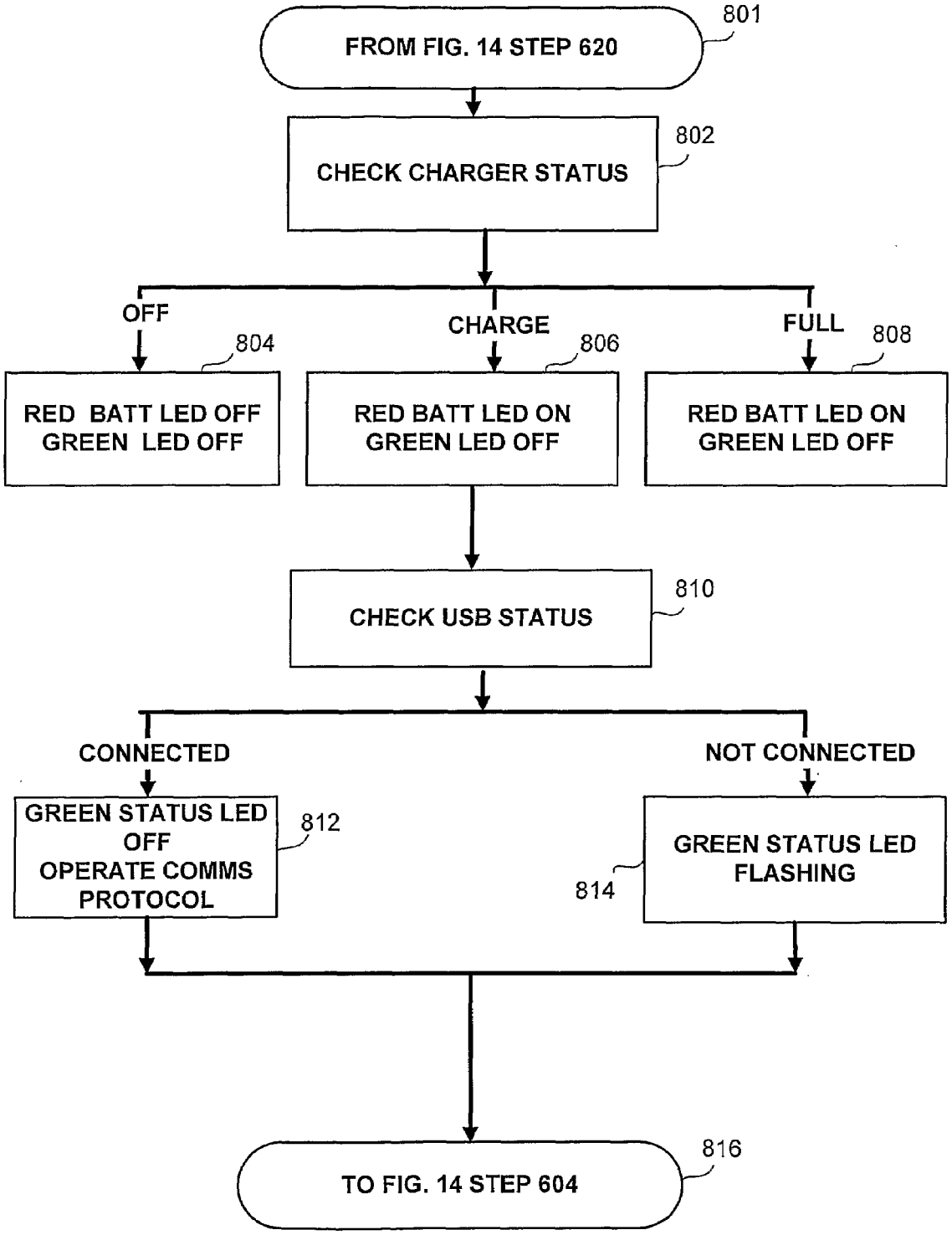

Referring now to FIG. 22 a simplified flowchart is shown that represents the logical flow of a sub-routine that implements a set of computer instructions called for and executed by the main logic of the computer program embedded in the microprocessor subsequent to the determination that the device is in the communication (USB & Charger) mode. At step 801 program control activates the communication (USB & Charger) mode sub-routine. At step 802 the status of the charger is checked. If the charger is disconnected then at step 804 the red battery LED and the green LED are both turned off. If the charger is connected and operating then at step 806 the red battery LED is turned on and the green LED is turned off. The charger indicates that the battery is fully charged then at step 808 the red battery LED is turned off and the green LED is turned on. Consequent to the checking of the status of the charger at step 810 the status of the USB connection is checked. If the USB cable is connected then at step 812 the green status LED is turned off and a communications protocol is activated in order to handle the communication process. If the USB cable is not connected then at step 814 the sub-routine issues a command to the control system for the flashing of the green status LED. Note should be taken that during the execution of the steps described above the operational mode of the device could change. Therefore, at step 816 program control loops back to the main logic sequence of the control program in order to enter the specific "determine mode" and to determine the current operational mode the device. In the context of the present invention a communication connection can comprise of any interfacing device to allow communication between various hardware elements, such as for example, USB, RS232 and the like.

The present invention includes a system, a method, a program product and a man-machine interface designed for activity monitoring of the operation of the control system of the computerized portable device. The system activity monitoring is based on specific information collected by the control system, encoded into machine-readable format and suitably stored as structured data on a memory device, such as a flash memory, associated with the microcontroller of the control system of the computerized portable device. Examples for the information collected and stored by the system were described herein above in association with the previous drawings. The system activity monitoring is performed by connecting either locally or remotely the computerized portable device to an external monitoring device. The external monitoring device is a computing device, such as a Personal Computer (PC), or the like. In the preferred embodiment of the present invention the monitoring device is a Pentium 3 compatible PC or higher, with a hard disk, a CD-ROM, and a high-quality display screen, such as having a screen resolution of 800×600 pixels or higher. The activity monitoring device is controlled by an operating system, such as for example Windows 2000, Windows XP, or the like. The activity monitor program product is a set of functionally interrelated compute programs installed on the hard disk of the activity monitoring device. The programs include a set of display structures designed for the screen-based displays and providing the man-machine interface between a user and the activity monitoring device. The screens are structured such as to provide an advanced graphical user interface (GUI) in order to enable the user to interact with the activity monitoring program via the manipulation input devices, such as a keyboard, a mouse, a light pen, a stylus, a microphone, a digital camera or the like. In the following description several exemplary display screens will be shown and described in association with the following drawings. Note should be taken that all the screens are exemplary only. In other preferred embodiments of the present invention the structure, the elements, the logical relationship and functionality of the screens could differ.

Figure 23:
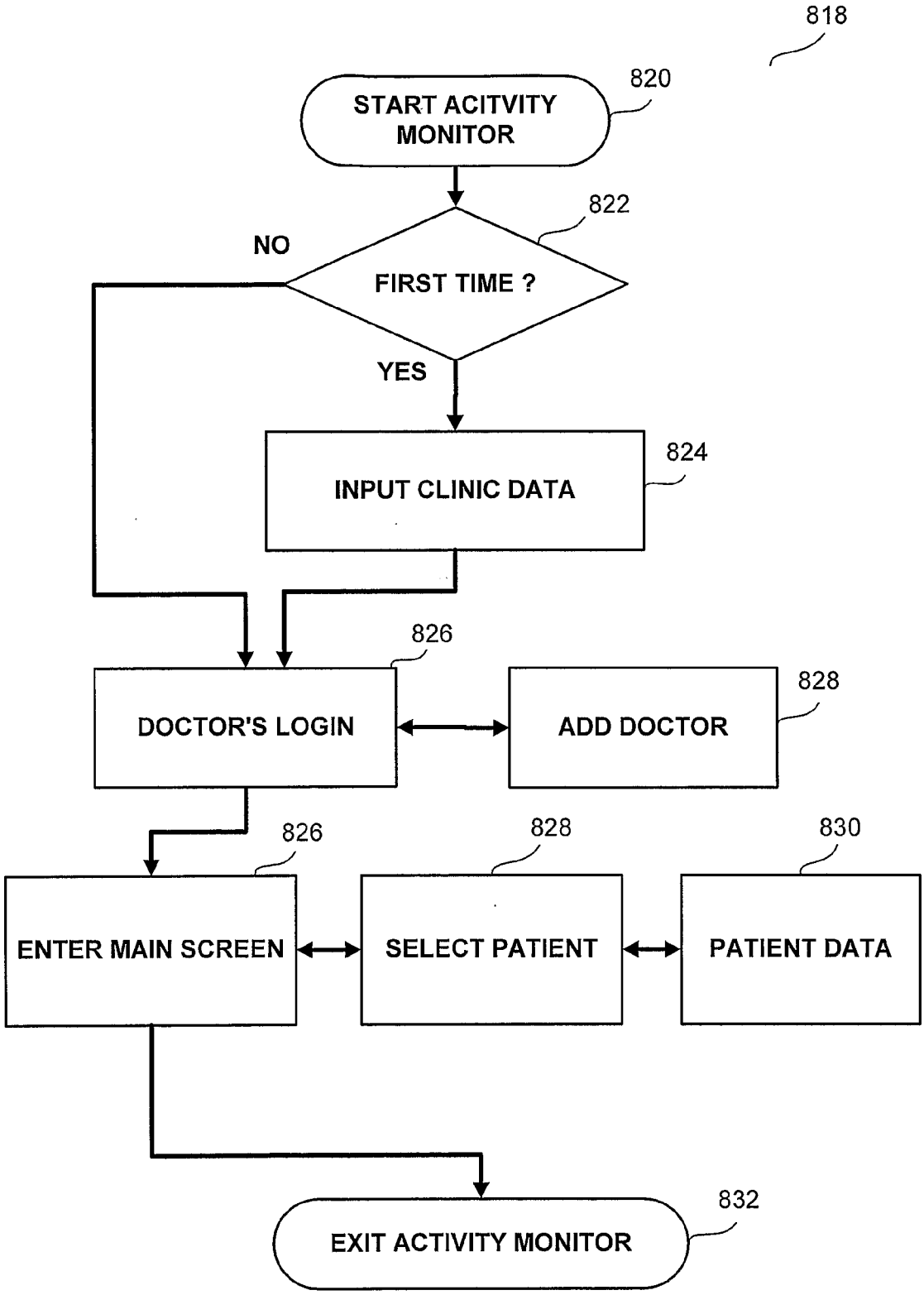
FIG. 23 is a high level flowchart representing the operational logic of the activity monitor.

Referring now to FIG. 23 the activity monitor is typically used by a health care provider, such as physician, a doctor, a qualified nurse, or a health care technician, when handling a patient who regularly uses the computerized portable device as a beneficial medical instrument. The drawing under discussion shows a high level flowchart illustrating the operational logic of the activity monitor. The activity monitor is started up at step 820 by a user, such as a physician, doctor, qualified nurse, or technician, consequent to the connecting of the computerized portable device to the external monitoring device. An s a result of starting of the activity monitor the program is loaded from the hard disk of the monitoring device and commences to execute. At decision-step 822 it is determined by the program whether it is the first time the activity monitor is used in the given specific environment, such as a medical establishment. The medical establishment could be a private physician office, a public health clinic, a hospital or the like. When the result of decision-step 822 is positive then at step 824 the "input clinic data" screen is loaded and displayed on the display screen of the monitoring device in order to enable the user to input information about the clinic in which the monitoring device and the associated activity monitor software are installed. The "doctor's login" screen is loaded (step 826) either after the inputting of the clinic data or alternatively after it had been determined at decision-step 822 that the monitoring device has been used before. The doctor's login screen could activate an additional "add doctor" screen (step 828) to allow for the introduction of information concerning a new physician. Following the login and/or the addition of personal information performed by the user, the main screen of the activity monitoring is loaded and displayed (step 826). In accordance with the type of the interaction with the user the main screen activates other display screens, such as a "select patient" screen 826, a "patient data" screen 830, and the like. The structure of the diverse screens, the user options, and the form of the interactions between the user and the activity monitor via the diverse screens, as well as the logical connections among the screens will be described herein under in association with the following drawings. When the user desires to terminate activity monitoring then following a suitable manipulation of a main screen element the user exits the activity monitor at step 832.

Figure 24:
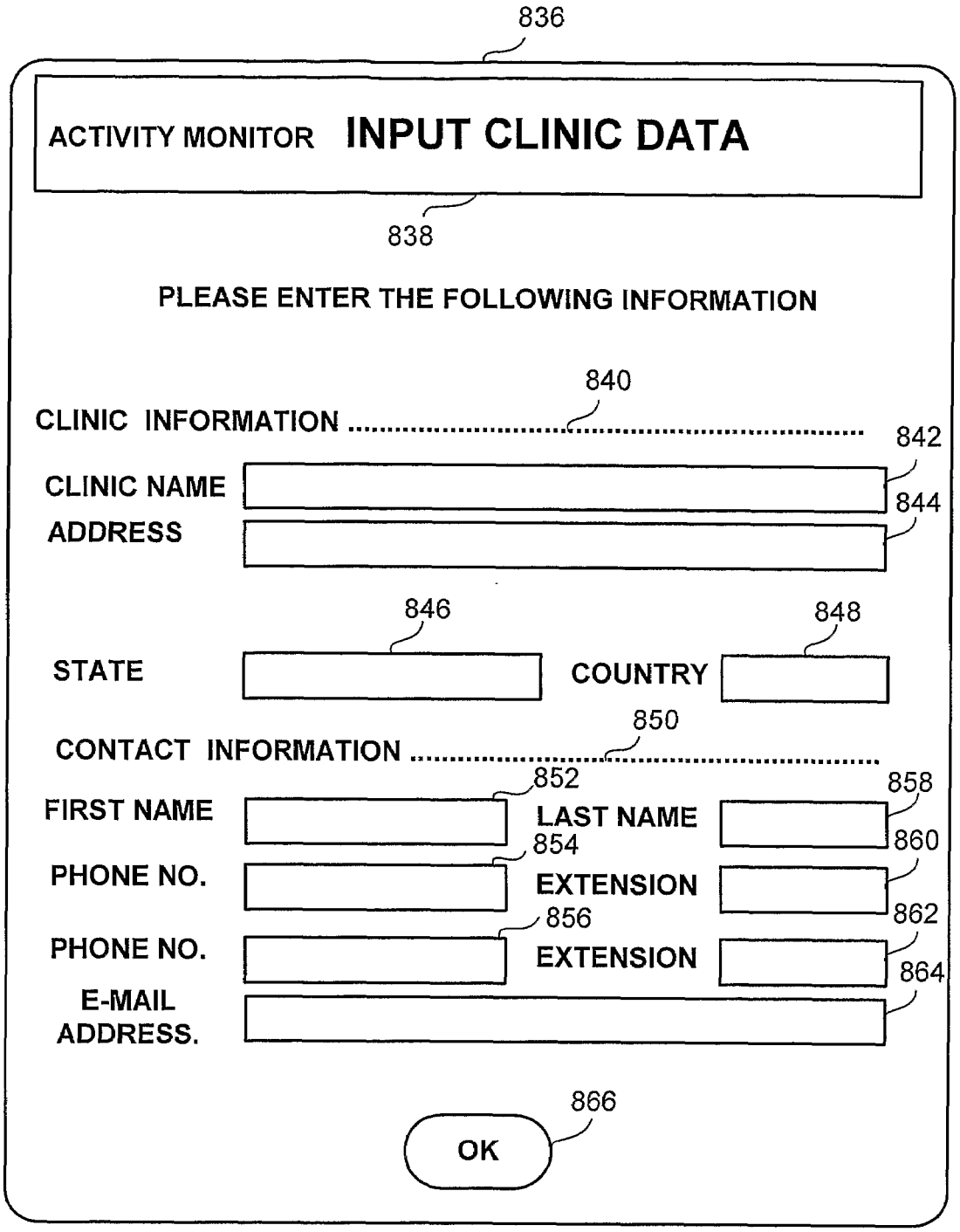
FIGS. 24-28 are schematic illustrations of the display and input screens utilized for the performance of interactions between a user and the activity monitor.

Referring now to FIG. 24, via the input clinic data screen 836 clinic-specific information is introduced into the activity monitor system. The input clinic data screen 836 is a graphical structure which is displayed on the display screen of the external monitoring device, such as a PC. The screen 836 allows for interaction with a user, such as enabling the user to enter information into text boxes associated with pre-defined data fields. The screen 836 includes a set of graphical elements, such as text boxes, buttons, descriptions, instructions, and the like. Thus, screen 836 includes a header box 836, a clinic information input region 840, a contact information input region 850, and an "OK" control button 866. The header box 836 includes informative text only, such as the name of the application ("Activity Monitor") and the name of the screen ("Input Clinic Data"). The clinic information input region 840 includes a clinic name text box 842, an address text box, 844, a state text box, 846, and a country textbox 848. The contact information input region 850 includes a first name text box 852, a last name text box 868, a phone number text box 854, an e-mail address text box 864, a first extension text box 860, and a second extension text box 864. All the above text boxes allow for the inputting of information of pre-defined type, structure and length. Via the entering of the required information the user introduces useful clinic-specific information into the activity monitor. Consequent to the filling of the text boxes the user could press the "OK" button 866 in order to command the input clinic data screen 836 to send the information to the system.

Figure 25A:
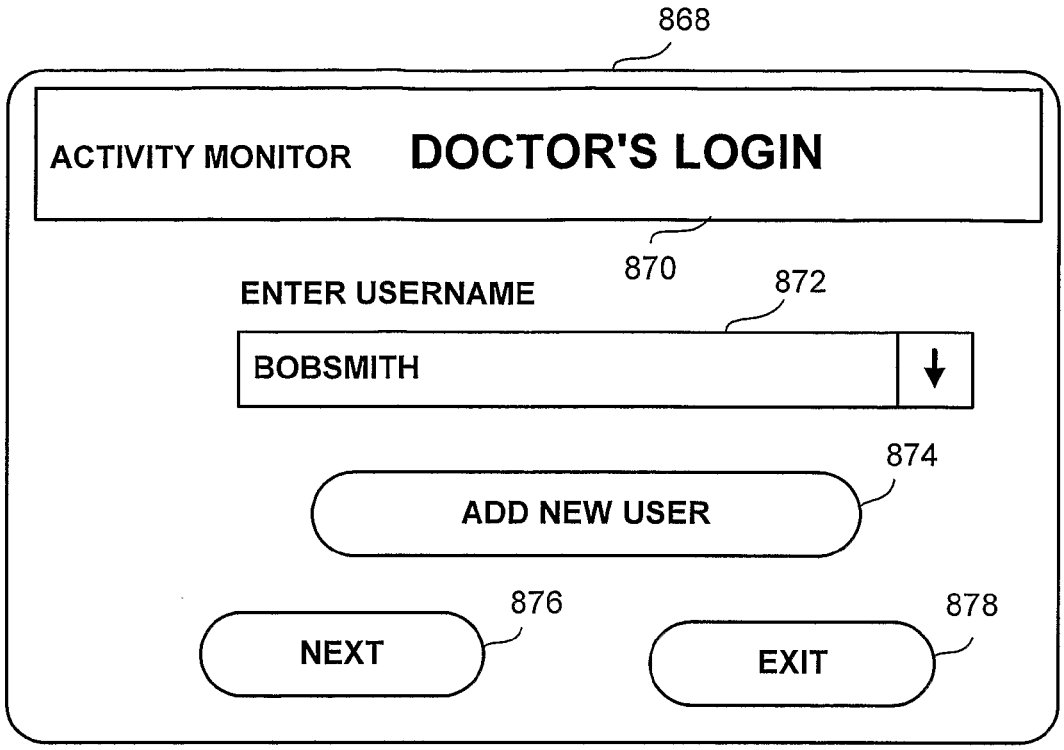

Referring now to FIG. 25A, the Doctor's Login screen 868 is used to select the physician that is currently desires to interact with the activity monitor. The doctor's login 868 is a graphical structure which is displayed on the display screen of the external monitoring device, such as a PC. The screen 868 allows for interaction with a user, such as enabling the user to enter required information into a text box or select an entry from a list box. The screen 868 includes a set of graphical elements, such as a text box/list box, buttons, descriptions, and the like. Thus, screen 868 includes a header box 870, a username text box/list box 872, an "add new user" control button 874, a "next" button 876 and an "exit" button 878. The header box 870 includes informative text only, such as the name of the application ("Activity Monitor") and the name of the screen ("Doctor's Login"). The box 872 is used to enter the user's identification for logging in or for selecting a user's identification from a pre-defined set of entries. When the user's identification is not recognized by the system then a new user could be added by activating the "add new user" button 874. Pressing button 874 will load the "add doctor" screen to allow for introducing information concerning a new user. The "next" button 876 allows for repeatedly adding a new user. The "exit" button 878 allows the user to exit the screen 868.

Figure 25B:
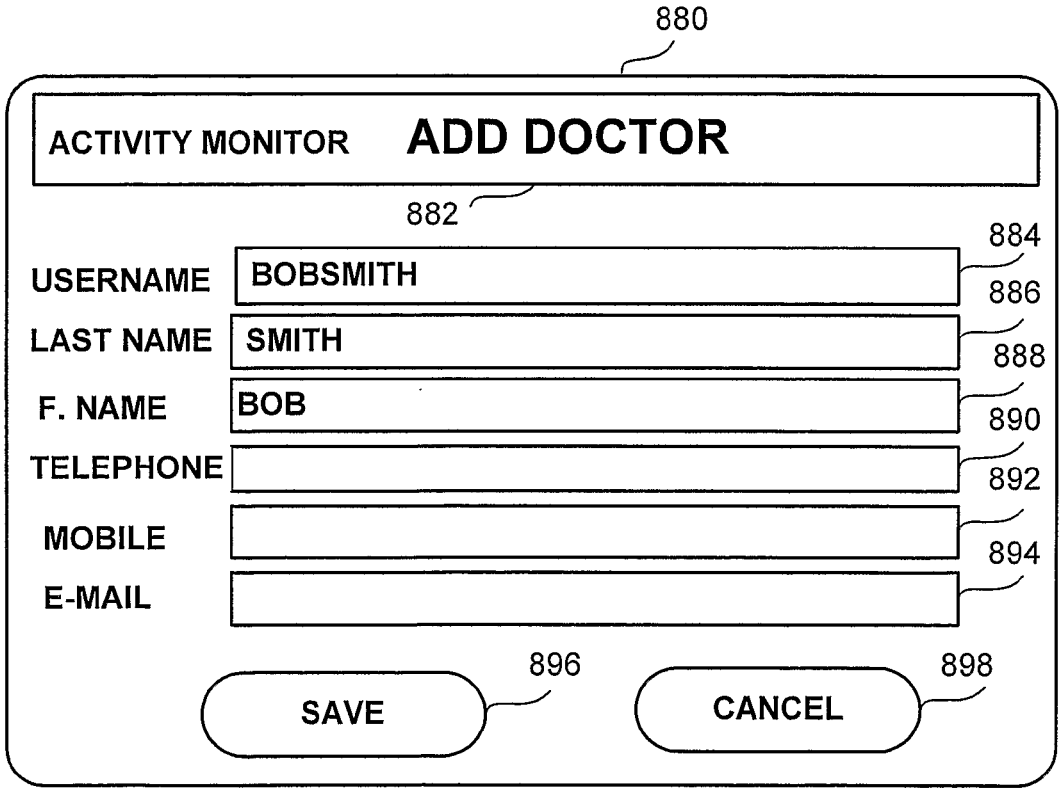

Referring now to FIG. 25B, the "Add Doctor" screen 880 is used to insert the personal details of a user to the activity monitoring system. The "Add Doctor" screen 880 is a graphical structure which is displayed on the display screen of the external monitoring device, such as a PC. The screen 880 allows for interaction with a user, such as enabling the user to enter required information into a text box or manipulate the information by a control button, or transferring control to another screen by a control button. The screen 880 includes a set of graphical elements, such as a text boxes, buttons, textual descriptions, and the like. Thus, screen 880 includes a header box 882, a username text box 884, a first name text box 886, a first name text box 890, a telephone number text box 892, a mobile phone number text box 894, an e-mail address text box 894, a "save" control button 896 and a "cancel" control button 898. The header box 882 includes informative text only, such as the name of the application ("Activity Monitor") and the name of the screen ("Add Doctor"). All the above-described text boxes allow for the inputting of information of pre-defined type, structure and length. Via the entering of the required information the user introduces personal information about a user into the activity monitor. Consequent to the filling of the text boxes the user could press the "Save" button 896 in order to command the add doctor information data to be sent to the system. Alternatively the user could press the "cancel" button 898 in order to abort the inputting of the data and to return to the "Doctor's Login" screen 868 of FIG. 25A.

Figure 26:
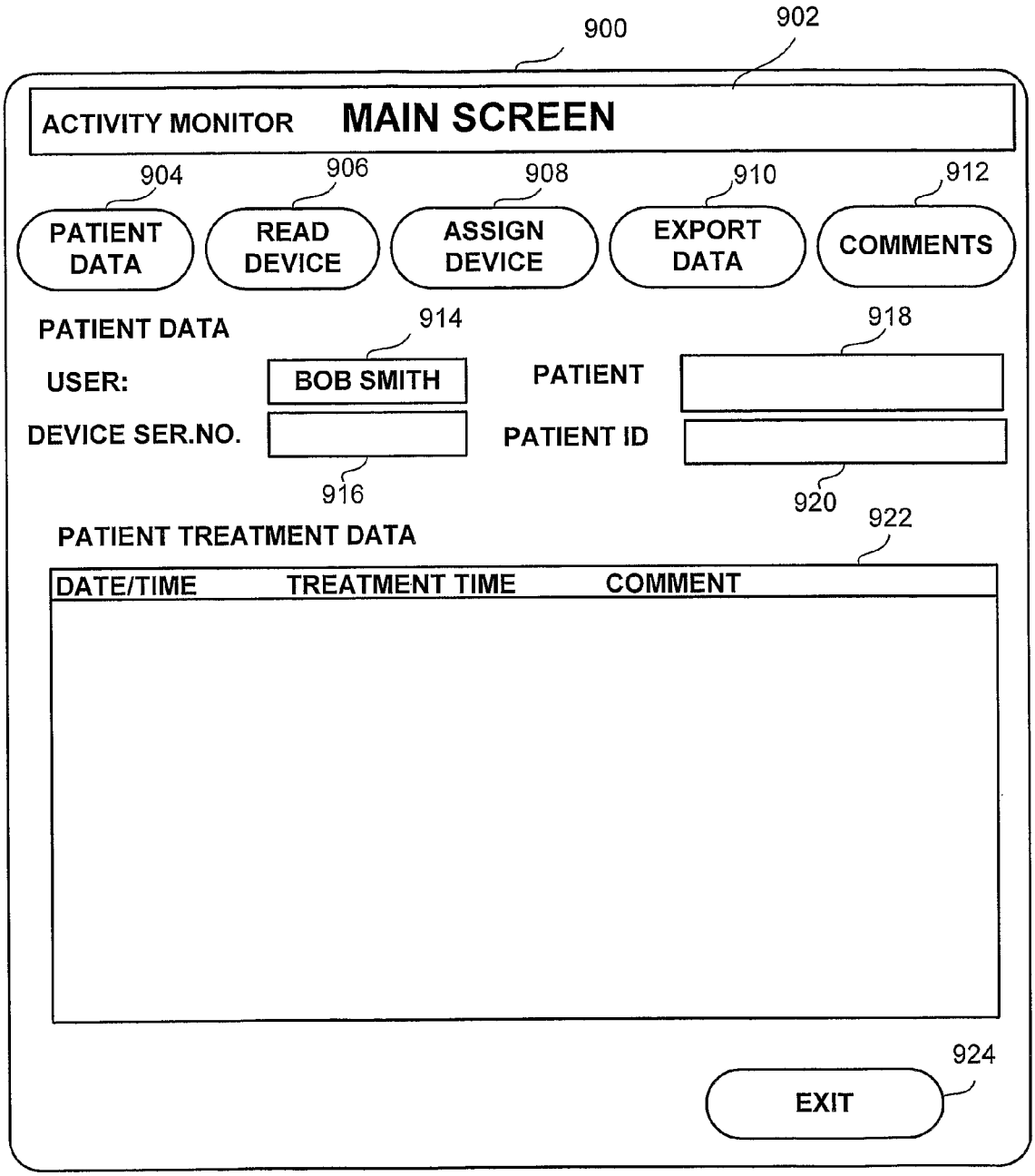
Figure 27:
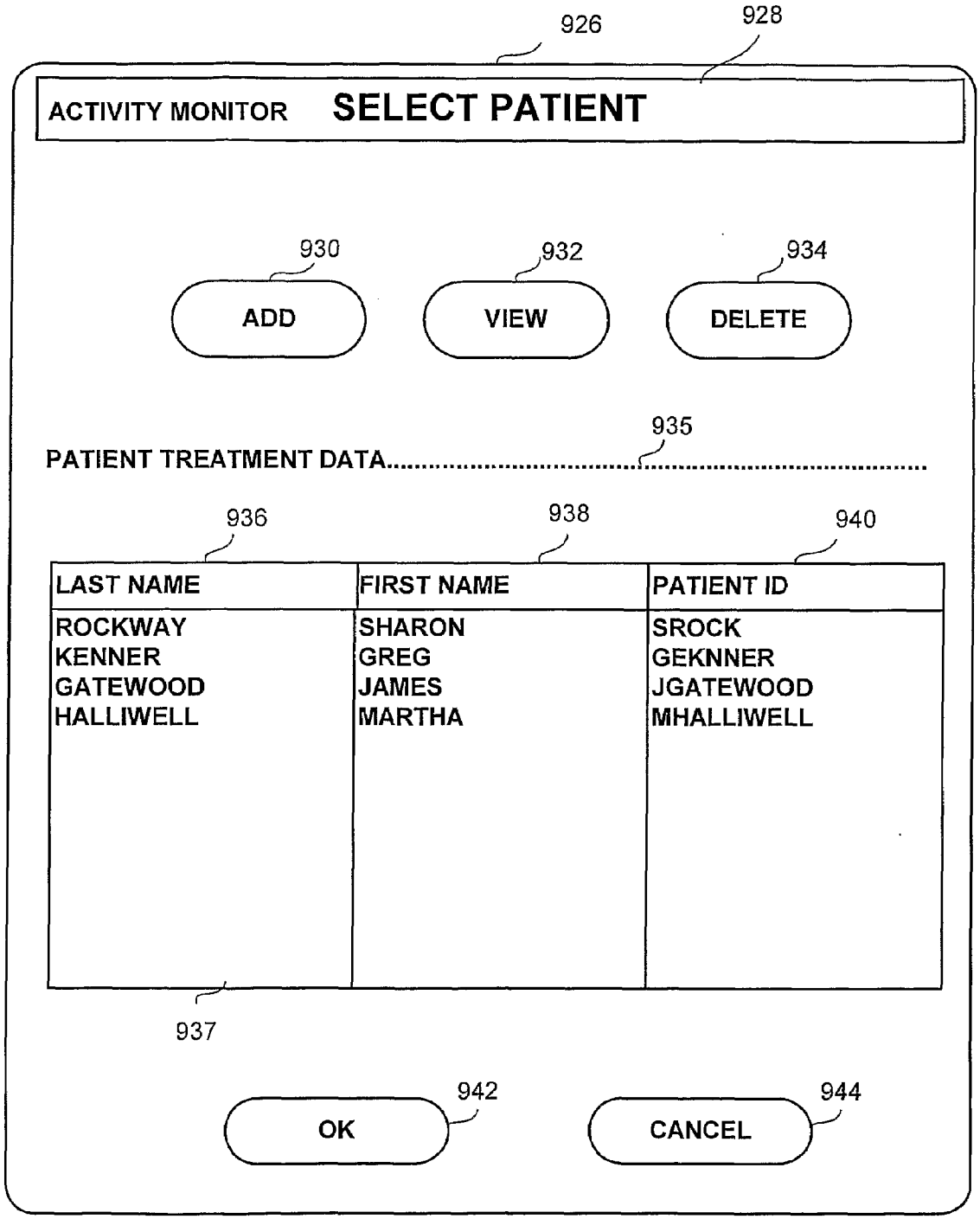

Referring now to FIG. 26, consequent to the logging on and/or to the insertion of a new user's data into the system program control will load the main screen of the program. The Main Screen 900 is the central screen via which all the functions of the activity monitor are called, loaded, executed, controlled and the patients' treatment data is reviewed. By suitably manipulating the control elements of the main screen 900, a patient could be selected, a portable device could be added to a patient, a patient's treatment history could be displayed, data could be exported or imported, various utility programs could be performed, and the like. The main screen 900 is a graphical structure which is displayed on the display screen of the external monitoring device, such as a PC. The screen 900 allows for interaction with a user, such as enabling the user to enter required information into a text box or manipulate the information by a control button, or displaying another screen by a control button. The screen 900 includes a set of graphical elements, such as a text boxes, list boxes, control buttons, textual descriptions, and the like. Thus, screen 900 includes a header box 902, a "patient data" control button 904, a "read device" control button 906, an "assign device" control button 908, an "export data" control button 910, a "comments" control button 912, a user identification text box 914, a device serial number text box 916, a patient name text box 918, a patient identification text box 920, a patient treatment data list box 922, and an "exit" control button 924. The header box 902 includes informative text only, such as the name of the application ("Activity Monitor") and the name of the screen ("Main Screen"). The control buttons 904, 906, 908, 910, and 912 are used for calling up and loading other display screen associated with various functionalities of the system. The user identification text box 914 is used to display the name of the user. The device serial number 916 is used to identify the portable device. The patient name 918 displays the patient name and the patent identification 920 displays the patient code. The patient treatment data list box 922 displays historical information about pat treatments of the patient by the portable device. The "exit" control 866. The header box 836 includes informative text only, such as the name of the application ("Activity Monitor") and the name of the screen ("Input Clinic Data"). The clinic information input region 840 includes a clinic name text box 842, an address text box, 844, a state text box, 846, and a country textbox 848. The contact information input region 850 includes a first name text box 852, a last name text box 868, a phone number text box 854, an e-mail address text box 864, a first extension text box 860, and a second extension text box 864. All the above text boxes allow for the inputting of information of pre-defined type, structure and length. Via the entering of the required information the user introduces useful clinic-specific information into the activity monitor. Consequent to the filling of the text boxes the user could press the "OK" button 866 in order to command the input clinic data screen 836 to send the information to the system.

Referring now to FIG. 25A, the Doctor's Login screen 868 is used to select the physician that is currently desires to interact with the activity monitor. The doctor's login 868 is a graphical structure which is displayed on the display screen of the external monitoring device, such as a PC. The screen 868 allows for interaction with a user, such as enabling the user to enter required information into a text box or select an entry from a list box. The screen 868 includes a set of graphical elements, such as a text box/list box, buttons, descriptions, and the like. Thus, screen 868 includes a header box 870, a username text box/list box 872, an "add new user" control button 874, a "next" button 876 and an "exit" button 878. The header box 870 includes informative text only, such as the name of the application ("Activity Monitor") and the name of the screen ("Doctor's Login"). The box 872 is used to enter the user's identification for logging in or for selecting a user's identification from a pre-defined set of entries. When the user's identification is not recognized by the system then a new user could be added by activating the "add new user" button 874. Pressing button 874 will load the "add doctor" screen to allow for introducing information concerning a new user. The "next" button 876 allows identification text box 966, and a patient treatment entries list box 968, and an "exit" control button 970. The patient treatment entries list box 968 displays selected patient-specific information logged by the control system for the patient during a series of treatments. The information includes date/time, treatment length, and comments.

Figure 28:
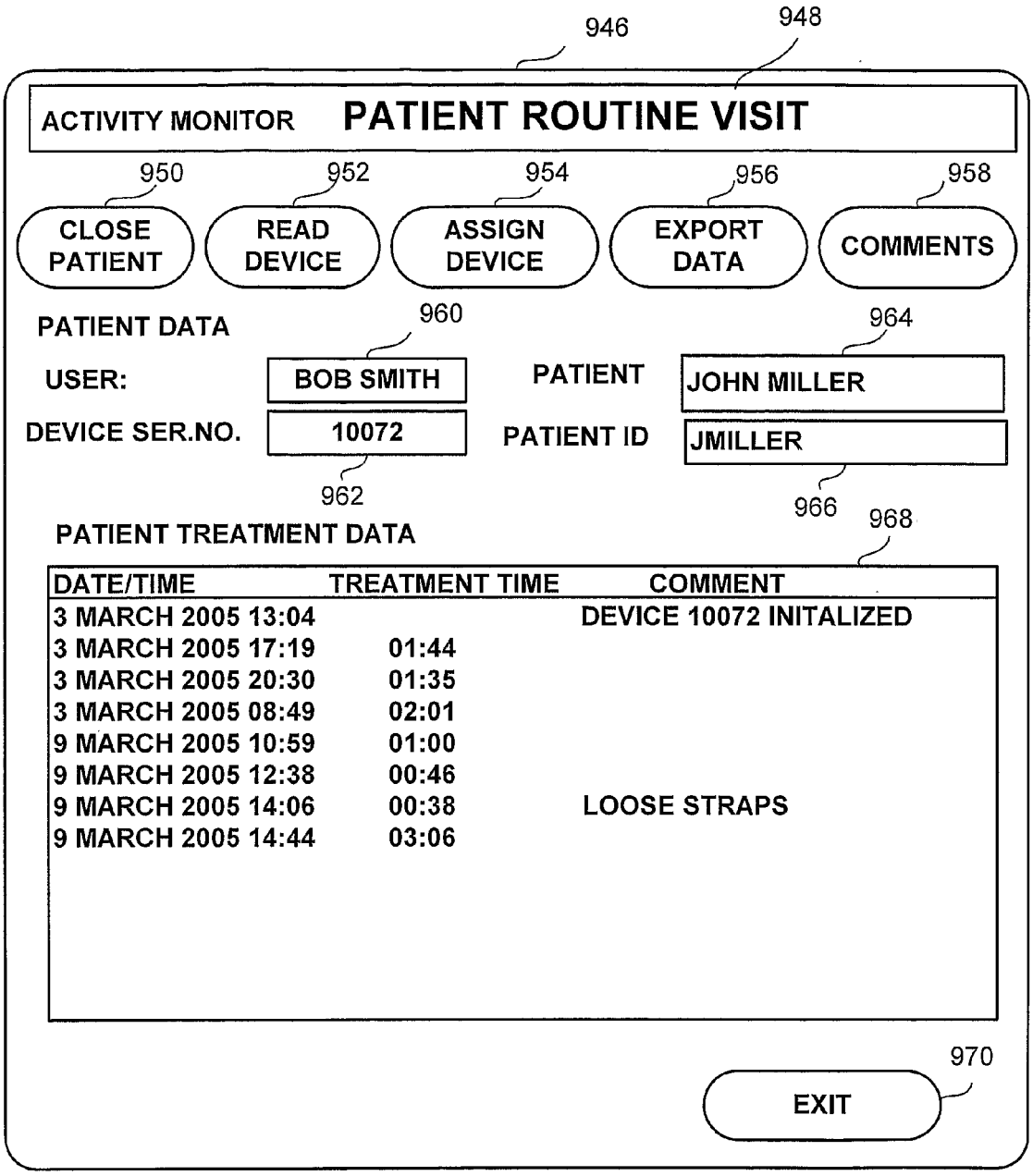

Still referring to FIG. 28 in the preferred embodiment of the invention when a patient visits his physician his assigned portable device is brought along. If the physician (the user) desires to interact with the treatment information logged on the portable device via the activity monitor then the activity monitor is initialized on a computing device used as the external monitoring device by the user. Then, the user logs in, and the patient's name is selected from the "select patient" screen. Consequently, the portable device is linked to a communications port of the external monitoring device, such as via a USB cable and USB connection. On the "select patient" screen the "read device" control button is pressed. The activity monitor will communicate with the portable device and will download all the information collected and recorded by the microprocessor since the patient's last visit. The downloaded information will be structured and displayed in the patient treatment entry list box 968. The date/time column will list the date and time the patient used the portable device, and the treatment time column displays how long the treatment lasted in hours and minutes. The comments column will include status information, such as "device 10072 is initialized" or fault information, such as "loose straps". Comments could be further added by the user for various purposes, such as pointers, notes, reminders, and the like.

Figure 29:
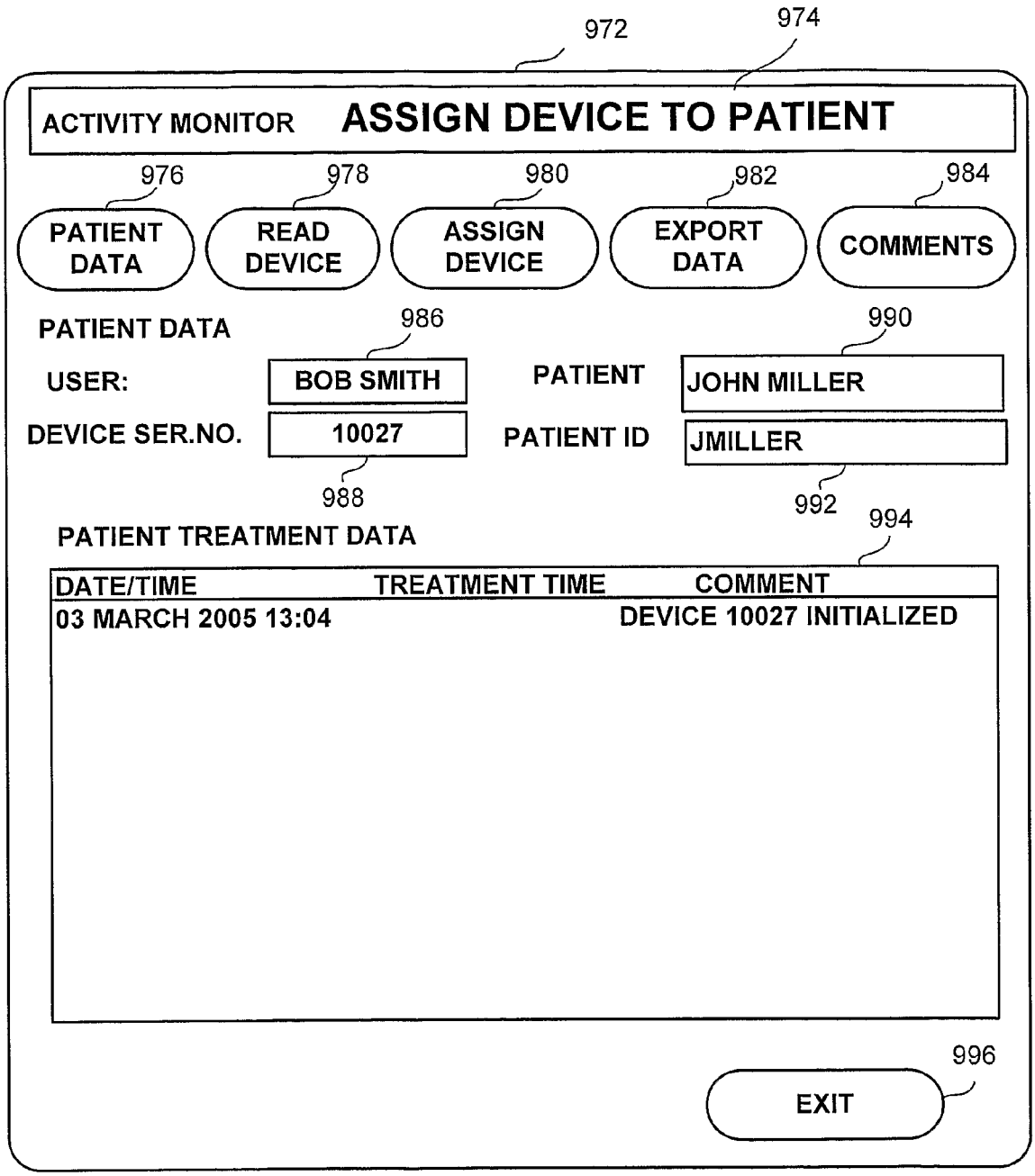

Referring now to FIG. 29 the assign device to patient screen 972 enables the user to assign a portable device to a patient. Typically only one portable device is assigned to one single user. The "Assign Device to Patient" screen 972 could be displayed either by manipulating specific control buttons in the main screen of the application. The screen 972 includes a header box 974, and a row of control buttons, such as "patient data" control button 976, and a "read device" control button 978, an "assign device" control button 980, an "export data" control button 982, and a "comments" control button 984. The screen 972 further includes a user name text box 986, a device serial number text box 988, a patient name text box 990, a patient identification text box 992, and a patient treatment data list box 994, and an "exit" control button 996. The patient treatment data list box 968 displays selected patient-specific information logged by the control system for the patient during a series of treatments. The information includes date/time, treatment length, and comments.

Still referring to FIG. 29 in the preferred embodiment of the invention when a physician's diagnosis results in the decision to start treating the patient by the portable device a portable device is provided to the patient. In order to enable activity monitoring the device should be assigned to the patient. The assignment is performed via screen 972 where the yet unassigned device is linked to the computer used as the activity monitoring device. First, the personal details of the patient should be entered into the computer via a patient information screen. Then the screen 972 is displayed. The assignment of the device to the patient is accomplished by inserting the patient's name into the patient name text box 990 and inserting the serial number of the device into the device serial number text box 988. The operation is finalized by the pressing of the assign device control button 980. Consequently, the patient treatment data list box 994 displays a line that notifies the user that the assignment was successfully completed. The assignment operation preferably will generate an entry in a device-patient assignment list in the activity monitoring device.

Note should be taken that the downloaded information is stored and saved on the activity monitoring device, such that a substantial history of the treatments will be available to the physician independently of the physical presence of the computerized portable device. The activity monitoring system includes several display screens designed for routine functions and specific utilities. These screens provide a useful and reliable interface between the user and the activity monitor. Examples for additional screens include: a) a device assignment screen to assign a portable device to a patient, b) diverse confirmation screens, c) information screens, d) backup utility and restore utility screens, e) data export and import screens, and the like.

While particular embodiments and applications of the present invention have been illustrated and described it is to be understood that the invention is not limited to the precise construction and composition disclosed herein and that various modifications, changes, and variations may be apparent from the foregoing descriptions without departing from the spirit and scope of the invention as defined in the appended claims. One skilled in the art can easily appreciate that according to other embodiments of the invention a device comprising one or more sensors located adjacent to a body of a user and coupled to the device, the sensors are used to measure physical body parameters of the user, and to generate electronic signals representing body parameter values and applying intermittent compression, the device can be either portable or not portable. Other embodiments of the invention can provide that sensors can be adjacent to a device providing intermittent compression on a limb wherein the device can provide the intermittent compression by pneumatic means (Intermittent Pneumatic Compression), mechanical means, other means or a combination thereof.

The invention claimed is:

1. A portable device for modifying blood or lymph flow in a limb of a user, the device comprising: an actuator configured for applying intermittent compression on said limb; an at least one sensor, located adjacent to the body of the user, to measure at least one physiological parameter of the user and to generate an electronic signal representing a measured value of said at least one parameter; and a transceiver coupled to the at least one sensor to receive signals generated by the at least one sensor and to transmit the signals received from the at least one sensor to at least one computing device located within or remotely from said device.

2. The device of claim 1 wherein the portable device is a limb-mounted device.

3. The device of claim 2 wherein said limb-mounted device comprises a compressing element, a motor and a mechanism driven by said motor configured to effectuate intermittent movement of said compressing element to apply intermittent pressure on said limb.

4. The device of claim 1 wherein the at least one computing device controls the operation of said actuator based on signals received from the at least one sensor.

5. The device of claim 4 wherein controlling the operation of said actuator based on said signals received the at least one sensor includes one or more of the following: initiating activation of said actuator, suspending activation of said actuator, terminating the activation of said actuator, selecting operation parameters for said actuator or selecting a pre-stored program for applying a controlled intermittent pressure on said limb in order to obtain a desired effect.

6. The device of claim 5 wherein said operation parameters are one or more of the following: cycle, pressure level, pressure duration, rest period, or pressure gradient at transients.

7. The device of claim 5 wherein said desired effect is any one of the following: desired flow during compression, desired flow during recovery, or desired blood pressure.

8. The apparatus of claim 4 further comprising at least one second sensor for monitoring the activity of said actuator.

9. The device of claim 8 wherein the computing device further comprises a record means for recording data received from the at least one sensor and the at least one second sensor and for storing said data for later analysis.

10. The device of claim 9 wherein the device further comprises a communication interface to enable uploading and downloading information from or to an external monitoring computer device.

11. The device of claim 9 wherein monitoring the activity of said device includes collecting information relating to start and stop times of operation periods and to operation parameters during said periods.

12. The device of claim 9 wherein monitoring the activity of said device includes detecting an operational mode of said device.

13. The device of claim 12 wherein the operational mode of the device comprise any one of the following: a power-up mode; a run mode; a fault mode; an off mode; a communication and charger mode; and a power-off mode.

14. The device of claim 9 wherein monitoring the activity of said device includes detecting a loose strap condition and/or a tight strap condition and/or a malfunction condition.

15. The device of claim 4 wherein the actuator comprises a motor coupled to said computing device, a compression element and a moving mechanism driven by said motor for actuating intermittent movement of said compressing element to apply intermittent pressure on said limb.

16. The device of claim 1 wherein the at least one sensor measures the user heart beat or the user body temperature.

17. The device of claim 1 wherein the at least one sensor measures any one of the following: blood pressure, blood volume flow, blood peak velocity, pulsatility index, tissue perfusion, capillary flow, tissue metabolism, oxygen supply, oxygen consumption, TCpO2, Tissue Laser Doppler, NOH levels, blood flow dilation, NADH, CO2, blood vessel condition, vasoconstriction, vasodilation, endothelial function, NO concentration, muscle activity, neuronal activity, blood flow constriction, patient daily activity, or patient's walking distance.

18. The device of claim 1 wherein said actuator is a limb mounted mechanical actuator.

* * * * *